United States Patent [19]

Dickinson et al.

[11] Patent Number: 4,635,937

[45] Date of Patent: Jan. 13, 1987

[54] AMUSEMENT MACHINE

[75] Inventors: Peter D. Dickinson; Robert A. Luciano, both of Reno, Nev.

[73] Assignee: IGT, Reno, Nev.

[21] Appl. No.: 664,185

[22] Filed: Oct. 24, 1984

[51] Int. Cl.[4] ..... A63F 5/04

[52] U.S. Cl. ..... 273/143 R; 335/261; 335/262; 339/75 M; 361/392

[58] Field of Search ..... 273/143; 335/261, 262; 339/75 M; 361/392

[56] References Cited

U.S. PATENT DOCUMENTS

| | | | |
|---|---|---|---|
| 571,792 | 11/1896 | Quinby | 335/261 X |
| 2,223,986 | 12/1940 | Eaton | 335/261 X |
| 2,735,965 | 2/1956 | Balanda | 339/75 M UX |
| 3,004,195 | 10/1961 | Peras | 335/261 |
| 3,191,097 | 6/1965 | Dano et al. | 339/75 M X |
| 3,510,814 | 5/1970 | Nordfors | 335/262 |
| 3,658,340 | 4/1982 | Ohki | 273/143 R |
| 3,735,302 | 5/1973 | Eckert | 335/262 |
| 3,910,582 | 10/1975 | Richards | 273/143 R |
| 4,037,845 | 7/1977 | Hooker | 273/143 R X |
| 4,045,109 | 8/1977 | Langenbach et al. | 339/75 M |
| 4,131,866 | 12/1978 | Torr | 335/262 |
| 4,132,384 | 1/1979 | Berg | 335/261 |
| 4,193,599 | 3/1980 | Heywood | 273/143 R |
| 4,238,127 | 12/1980 | Lucero et al. | 273/143 R |
| 4,239,225 | 12/1980 | Burnside | 273/143 R |
| 4,262,906 | 4/1981 | Heywood | 273/143 R |
| 4,421,310 | 12/1983 | Williams | 273/143 R |
| 4,427,196 | 1/1984 | Hooker et al. | 273/143 R |
| 4,445,740 | 5/1984 | Wallace | 339/75 M X |
| 4,539,542 | 9/1985 | Clark | 335/261 |

OTHER PUBLICATIONS

IBM Technical Disclosure Bulletin, vol. 13, No. 9, 2-1971.

*Primary Examiner*—Paul E. Shapiro

*Attorney, Agent, or Firm*—Townsend and Townsend

[57] ABSTRACT

A slot machine having multiple spinning reels coaxially mounted in a frame for relative rotation. All machine movements are electrically activated by pulling a starting handle. The handle operates an electric switch which, in turn, initiates sequencing of the machine by a processor.

A spinning arresting mechanism for each reel is constructed as a unitary module which can be plugged into the machine or readily removed therefrom. The module includes start and stop solenoids cooperating with a single, spring-powered lever and associated linkage for guiding the lever through a three phase movement. During the first phase, the lever moves from its reel arresting position to its reel spinning position. During this movement, the lever engages a sprocket connected with the reel and thereby imparts rotational movement to the reel. In the second phase, the lever, after having completed the spinning of the reel, moves towards a cocked position where the lever rests out of contact with the sprocket. During the third phase, the lever moves from its cocked position back into engagement with the sprocket for arresting the rotation of the reel when a preselected peripheral reel field appears at the display window. The first and third movement phases are powered by springs which form part of the module. The second movement phase is effected by a power-driven cam of the machine which engages appropriate linkage of the module and applies the required energy to stress the springs for powering the lever during its first and third passes.

54 Claims, 18 Drawing Figures

AMUSEMENT MACHINE

BACKGROUND OF THE INVENTION

The present invention relates generally to amusement machines having rotating reel assemblies, and specifically to coin-operated slot machines of the type found in Monte Carlo, Reno, and other internationally known gaming resorts.

A major factor in the design of slot machines and other rotating reel devices is their ability to withstand the stress of repeated impact loading caused by rapid acceleration and deceleration of the reel assemblies. Rapid changes in reel speed subject these machines to forces which cause fatigue and/or failure in structural members. In addition, such acceleration intensifies surface friction and grinding between moving parts, creating shavings and other abrasive particles which spread throughout the machine and decrease the useful life of bearings, solenoids, and other parts having opposed moving surfaces to which the debris is carried. Accordingly, frequent repair and maintenance is required, resulting in high servicing costs.

The profitability of these machines is further reduced by the percentage of "down time" required for servicing, during which the machine produces no revenue. This is particularly true in the case of slot machines and the like, in which multiple rotating reel assemblies and their associated driving mechanisms create a maze of interlocking mechanical elements which may require hours of disassembly to reach an affected part. Extensive disassembly often necessitates removal of the machine from the premises, increasing the cost of repair and associated down time.

Prior attempts to address these problems have not always been entirely successful. One such attempt involved the use of multiple plug in/plug out modules in a slot machine, permitting removal of a single faulty module without disassembling the entire machine. The faulty module could be replaced with a spare during servicing, thus reducing down time and simplifying periodic maintenance or repair.

An example of such a module is seen in U.S. Pat. No. 3,910,582, in which a single reel assembly is rotatably mounted to a removable plate, along with its associated starting and stopping mechanisms. The reel assembly is started and stopped by electrical signals received through mating connector plugs mounted on the module plate and on the machine. Each module has a motor for spinning its associated reel, and an indexing disk having notches about its periphery which are engaged by a stop solenoid to stop the spinning reel when power to the motor is cut off. A resistor ladder network is connected to contact points mounted in two concentric circular arrays on the indexing disk, establishing a different resistance associated with each rotational position of the reel. A pair of electrical wipers couple the contact points to the connector plug so that the reel position may be sensed by external circuitry after the reel has stopped spinning, and a determination made of whether the new reel positions of the various modules display a winning combination.

While such an arrangement allows relatively rapid replacement of a single module for cleaning or repair, this configuration has not met with considerable success. Modular units of this construction are not well suited for use with a large reel having many rotational stopping positions, because the acceleration and deceleration of large reels creates an unacceptable level of strain and structural failure in the modules, thus defeating their intended purpose of simplifying repair and reducing down time. Such modules are also expensive to make, and, with respect to most slot machines, are so large and heavy that a serviceman cannot carry many modules with him at one time.

Another drawback of existing slot machines has been the expense and complexity of mechanisms for starting and stopping reel rotation. In the past, these mechanisms have generally fallen into two categories. The first uses a spring-loaded pawl arm engaging a sprocket to rapidly spin the sprocket and its attached reel when the starting lever is pulled, and a spring-loaded or solenoid actuated stop lever which engages one of the sprocket teeth to rapidly stop the reel at a position where one of its indicia is displayed at the "center line" of a viewing window. These mechanisms require precise alignment of the pawl arm and the stop lever in order to accurately engage the sprocket teeth, involving a complex assembly of inter-related mechanical parts. Such assemblies require regular maintenance, since the jarring action of starting and stopping the reel assembly may disturb the relative alignment of the pawl arm and stop levers.

The second type of mechanism which has been used for controlling reel rotation in slot machines couples each reel assembly to an electric motor when the starting lever is pulled, and stops the assembly with a solenoid engaging a notch in an indexing disk, as in the above described U.S. Pat. No. 3,910,582. While these systems do not present the same alignment problems of the above dual arm mechanisms, they are subject to comparable drawbacks related to player satisfaction and high cost.

Slot machine players have generally developed a preference for the sound, feel, vibration and rapid reel acceleration which is provided by a spring-loaded pawl type starting mechanism. In order to simulate the acceleration of pawl mechanisms, high-torque motors must be used, especially in machines having a large reel with high rotational inertia. Such motors are large, heavy, expensive, and have high current draw especially during the initial period when the reel is accelerating rapidly from rest to full speed. Accordingly, the high cost of manufacture, electricity, and installation of adequate wiring, along with customer preference for the sound and feel of pawl type mechanisms, create significant disincentives to the use of electric motors. Also, the above-mentioned environment inside such machines exposes the motors to abrasive particles which rapidly wear out motor bearings, requiring regular maintenance.

In addition to the above problems of reel starting and stopping mechanisms, design problems specific to reel assemblies have arisen due to the shearing force and abrasive wear to which these assemblies are subjected, especially during deceleration. Reel assemblies having a reel mounted in a frame for rotation with a sprocket or indexing disk are well known as a means for translating the motion of a pawl arm to rotary motion for turning the reel, and for abruptly stopping this rotation by engaging the sprocket or indexing disk with a lever pivotally mounted to the machine frame. However, this abrupt stopping motion creates extremely high stress in the reel assembly and frame, especially where a large diameter reel having high rotational inertia is used. This has required manufacturers of such machines to either limit the size of their reels or use expensive, high strength alloys.

While some attempts have been made to address this problems, they have not been entirely successful. For example, U.S. Pat. No. 4,239,225 discloses a reel stopping mechanism for a reel assembly having an indexing disk fixedly mounted to the reel. The reel stopping mechanism comprises a stop lever pivotally mounted at one end to a fixed point on the supporting frame, the other end having a pin for engaging the notches of the indexing disk to stop the reel assembly. The stop lever's middle portion is designed to enable the lever to extend and retract, and is spring-loaded to hold the lever in its fully retracted position. A stop solenoid pivots the lever into and out of engagement with the notches of the indexing disk. As the lever engages the rotating disk, its spring-loaded middle portion extends to help absorb the impact, then retracts to its original position. While this configuration helps reduce stress loads on the reel and frame, it is expensive to manufacture and subjects the solenoid to sharp lateral forces. This may cause erratic solenoid operation due to excessive wear and binding, resulting in a stopping action which is not consistently timed. It is therefore unsuitable for applications where precise timing of the stop lever is necessary to stop the reel assembly at a predetermined position.

A related problem to the above-mentioned drawbacks of slot machines and the like has arisen in conjunction with the operation of solenoids in an environment where foreign particles may lodge between the solenoid body and the plunger, causing wear, sluggish operation and intermittent binding. This is a particular problem in applications where timing of the solenoid movement is critical, as where the solenoid's activation is timed to control the engagement of two relatively moving objects. In such cases, very small accumulations of debris may cause conventional solenoids to misfire, requiring frequent servicing to clean or replace the solenoid.

Existing solenoids also require that design accommodations be made to permit unrestricted axial movement of the plunger, since pressure lateral to the solenoid axis results in binding and wear between the plunger and solenoid body. These problems are commonly addressed by cutting a slot in the arm to which the plunger is attached, so that a pin connecting the plunger and arm may ride in the slot to relieve lateral pressure. However, such slots typically require machining operations which are expensive and time-consuming. Furthermore, friction between the connecting pin and slot may still cause lateral pressure sufficient to bind the plunger, especially where the only other force on the plunger is the relatively weak pull of the solenoid coil.

While some solenoids have addressed this problem by providing pivotable plungers, these devices are capable of only very limited application. For example, the above-mentioned U.S. Pat. No. 4,239,225 discloses a solenoid, coupled to its stop lever, having a plunger which is pulled axially out of the solenoid body after the coil is de-energized, and then laterally pivots at the end of its stroke to permit the stop lever to extend in a direction perpendicular to the solenoid axis. This feature is only effective for mechanisms in which the plunger head describes an L-shaped movement. It also does not provide a structure which reduces surface friction and binding between opposed solenoid surfaces.

In addition to problems relating to cost and mechanical integrity, prior art slot machines have the common drawback that their operation is excessively repetitive, involving almost no thought or imagination on the part of the player. A player who simply repeats the process of depositing a coin, pulling the handle, and watching for a winning combination on the center line rarely finds enough stimulation to command his attention for long periods of time. Since a payout is the only thing which interrupts this cycle, the machine odds must be set to provide payouts often enough to maintain the average player's interest, decreasing the amount of revenue available to the owner of the machine. A slot machne which offered a player a choice between repetitive "coin pumping" and other playing formats would more actively involve him in the game playing process, reduce the level of boredom in periods between winning payouts, and generally increase user enjoyment, enabling the owner of the machine to set more favorable odds without a corresponding offset in player enthusiasm.

OBJECTS OF THE INVENTION

It is a broad object of the present invention to provide an amusement machine which alleviates the above-mentioned drawbacks of prior art devices.

It is a particular object of this invention to provide an amusement machine which is durable, inexpensive to manufacture and operate, and easy to repair.

It is a further object to provide an improved slot machine which permits a player to select between different playing formats so as to increase the level of player interest and participation.

These and other object and features will become apparent from the following summary and description of the preferred embodiments of the present invention.

SUMMARY OF THE INVENTION

The present invention is primarily directed to an amusement machine having multiple spinning reels, frequently referred to as a "slot machine", which overcomes many of the shortcomings encountered with prior art machines of this type. In particular, the present invention overcomes many of the difficulties encountered in the past when servicing or repairing slot machines after extended use and greatly reduces machine downtimes which result in an enhanced profitability. Operationally, the present invention significantly reduces the shock loads to which the components of the machine, and particularly the rotating reels are subjected. Consequently, slot machines constructed in accordance with the present invention are subjected to fewer breakdowns and routine service is less frequently required. The reduction of the shock loads to which the moving components of the machine are subjected makes it feasible to increase the diameter of the rotating reels. This significantly increases the periphery of the reels and makes it possible to increase the number of peripheral reel fields at which the reel can be stopped at the end of a game. For a slot machine with a given number of reels, say three, the odds of a win can thereby be increased significantly, permitting the operator of the machine to correspondingly increase the maximum payout that can be attained with the machine. This is accomplished without increasing the complexity of the machine as would be necessary, for example, when an increase in the odds can only be attained by increasing the number of reels in the machine.

These benefits are attained while maintaining the machine attractive for the user. All machine movements are electrically activated by pulling what appears to be a conventional handle. The handle operates an electric switch which, in turn, initiates the sequencing of the operation of the machine.

Generally speaking, a slot machine constructed in accordance with the present invention provides a plurality of reels which are co-axially mounted within a frame for relative rotation. Both the rotation of the reels and their arrest are initiated by a single, spring-powered level provided for each reel. Start and stop solenoids cooperate with the lever to sequentially release pre-tensioned springs for moving the lever in a first direction, to initiate reel rotation, and a second direction, to arrest the reel rotation. The firing of the solenoids is controlled by a processor which randomly pre-selects the peripheral fields of the reels which are to appear at a game display window of the machine to determine whether or not the play resulted in a win and, if it did, the amount of the payout.

To facilitate the servicing of the slot machine, and in particular the reel spinning and arresting mechanism, the lever and associated springs, solenoids and linkage for each reel are constructed as a unitary module which can be plugged into the machine or readily removed therefrom. After removal of the module, for repair or servicing, a replacement module can be snapped into the machine so that there is virtually no downtime. Repair and servicing can take place in an efficient and orderly manner, at a specially equipped repair facility, for example, while the use of the machine for play can continue uninterrupted.

In a preferred embodiment of the invention, the reel spinning and arresting lever is guided through a three-phase movement. During the first phase of the movement, the lever moves from its reel arresting position to its reel spinning position. During this movement, the lever preferably engages a sprocket or the like connected with the reel and thereby imparts rotational movement to the reel. In the second phase of the movement, the lever, after having completed the spinning of the reel, moves towards a cocked position where the lever rests out of contact with the sprocket. During the third phase of its movement, the lever moves from its cocked position back into engagement with the sprocket for arresting the rotation of the reel when the preselected peripheral reel field appears at the display window. The first and third movement phases are powered by springs which form part of the module. The second movement phase is effected by a power-driven cam of the machine which engages appropriate linkage of the module and applies the required energy to stress the springs for powering the lever during its first and third movement phases.

The reel spinning/arresting module of the present invention, aside from being virtually instantaneously replaceable, utilizes a single, lightweight lever to spin and stop the reel. It is of a relatively simple construction and, therefore, relatively inexpensive to construct and maintain. Its light weight minimizes the inertia which has to be overcome at the beginning of the first and third movement phases to spin and arrest the reel. Thus, the module makes it possible to achieve the desired high spin rate and virtually instantaneous arrest of the reel upon corresponding commands from the central processing unit. The latter aspect is particularly important for the accurate control of the reel arrest.

Another aspect of the present invention minimizes shock loads generated by the reel during its arrest, while providing a reel diameter substantially larger than feasible with prior art slot machines. This is achieved by constructing the reel of a lightweight, preferably translucent plastic. A lightweight but strong sprocket is attached to the reel for cooperating with the above-mentioned reel spinning/arresting lever. Shock loads are reduced in accordance with the present invention by mounting the sprocket to the reel so that relative rotational movements between them in a first rotational direction are prevented when the two are in a predetermined angular orientation. However, relative rotational movement between the reel and the sprocket is permitted over a limited arc in the opposite rotational direction. A spring or the like is interposed between the reel and the sprocket to resist such relative rotational movement except when a relatively large shock force is applied, i.e. when the lever engages the sprocket to arrest the reel rotation. The spring permits a slight overtravel of the reel beyond the arrest position of the sprocket and thereafter returns it to its normal position relative to the sprocket. To prevent undesirable oscillations, a friction clutch is interposed between the reel and the sprocket.

Another aspect of the present invention relates to the protection of moving components against wear and tear from contaminants which accumulate within the machine during its operation, at least in part as a result of abrupt movements such as the abrupt arrest of the rotating reel. In this respect, the present invention provides a specialized construction for the start and stop solenoids which cooperate with the reel spinning/arresting lever so that dust accumulations do not impair the response time of the solenoids which, if permitted to take place, could affect the arrest of the reel at the proper rotational position.

The present invention also isolates the reel from the sprocket and contaminants to limit the wear and tear to which the reel is subjected during use. Further, the invention provides for the lubrication of the reel bearings while minimizing the danger of dust accumulation within them which, if allowed, could impermissibly or, at least, undesirably reduce the rate of rotation of the reel during play.

Thus, the present invention provides a slot machine which has an attractive appearance and is attractive to play. Of equal importance to the operator of the machine, the present invention greatly simplifies its construction, maintenance and repair so that the operator can minimize downtimes of the machine, optimize its play time and, therefore, increase the profits he can derive from the machine.

DESCRIPTION OF THE PREFERRED EMBODIMENT

Figure 1:
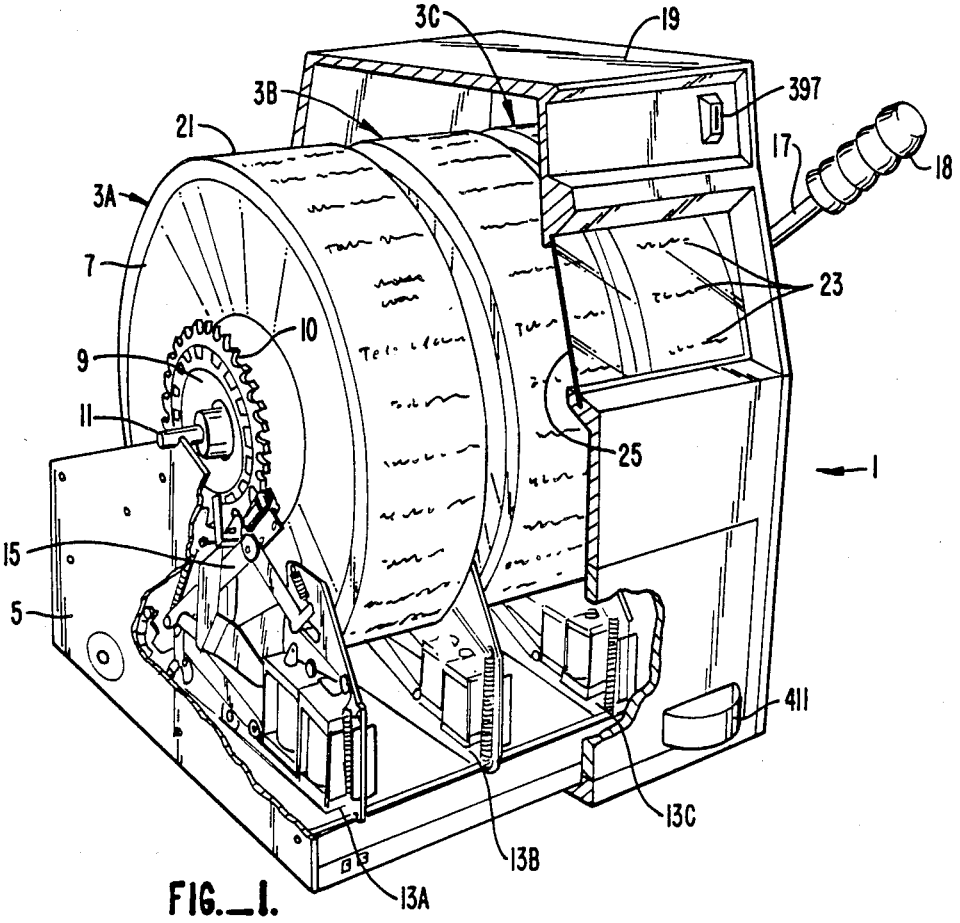
FIG. 1 is a perspective view of a slot machine according to the present invention, having portions cut away to expose the inventive reel assemblies and rotation governing modules.

FIG. 1 is a cutaway perspective view of an amusement, e.g. slot machine 1 constructed in accordance with the invention. Reel assemblies 3A, 3B and 3C are coaxially mounted in frame 5, and are independently rotatable relative to each other. Each of the reel assemblies 3 comprises a reel 7 mounted for rotation with a corresponding sprocket 9 on axle 11. Three rotation governing modules 13A, 13B and 13C are releasably mounted in frame 5 adjacent their corresponding reel assemblies 3A, 3B and 3C. Each of the modules 13 has a pawl arm 15 engaging the teeth 10 of its corresponding sprocket 9 for starting and stopping the rotation of its corresponding reel assembly 3. Each of the modules is actuated by electrical signals from a control circuit 16 (discussed later with respect to FIG. 15), such as a microprocessor, which synchronizes the starting and stopping of reel assemblies 3A, 3B and 3C after receipt of a starting signal which is generated in response to a manually operable input device, such as starting lever 17.

An operator signals the start of a round of game play by pulling the handle 18 of starting lever 17, which is pivotally mounted on the side of housing 19, and spring biased to a neutral position. When the lever 17 is pivoted away from its neutral position, the control device 16 signals modules 13 to spin their respective reel assemblies 3. Reels 7 each have a peripheral rim 21 displaying various game playing indicia 23 (such as cherries, oranges, gold bars and other readily identifiable symbols) at designated locations on the peripheral rim 21. Upon receipt of a second signal from the control device 16, each module 13 stops the spinning of its respective reel assembly 3, and a new sequence of indicia 23 is displayed to the operator through window 25. Machine 1 may thus be used to play a game in which the operator wins or loses a given round of game play according to the sequence of indicia 23 in window 25.

FIGS. 2–5 illustrate the construction and operation of module 13 in relation to its corresponding reel assembly 3. Pawl arm 15 is coupled to a base plate 27 of module 13 by means of a linkage system, described below, which guides the pawl arm through a three phase movement relative to the base plate. This three phase movement of pawl arm 15 both initiates and stops the rotation of reel assembly 3.

Figure 4:
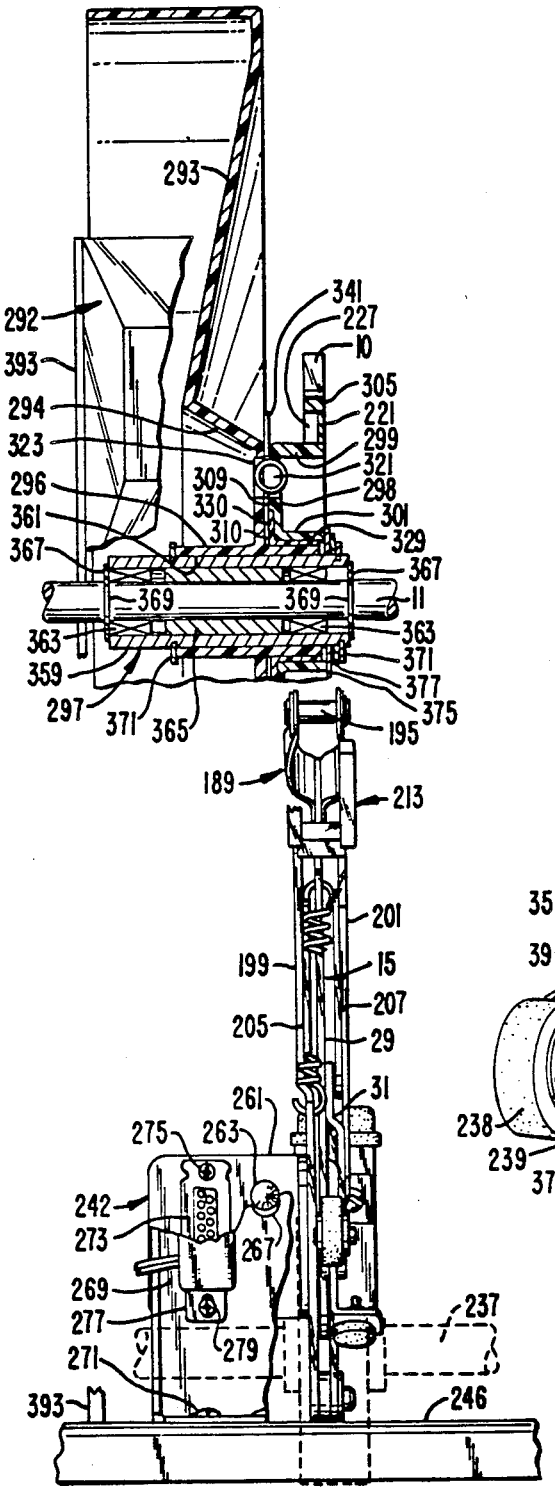
FIG. 4 is a sectional view along line 4—4 of FIG. 2A.
Figure 5:
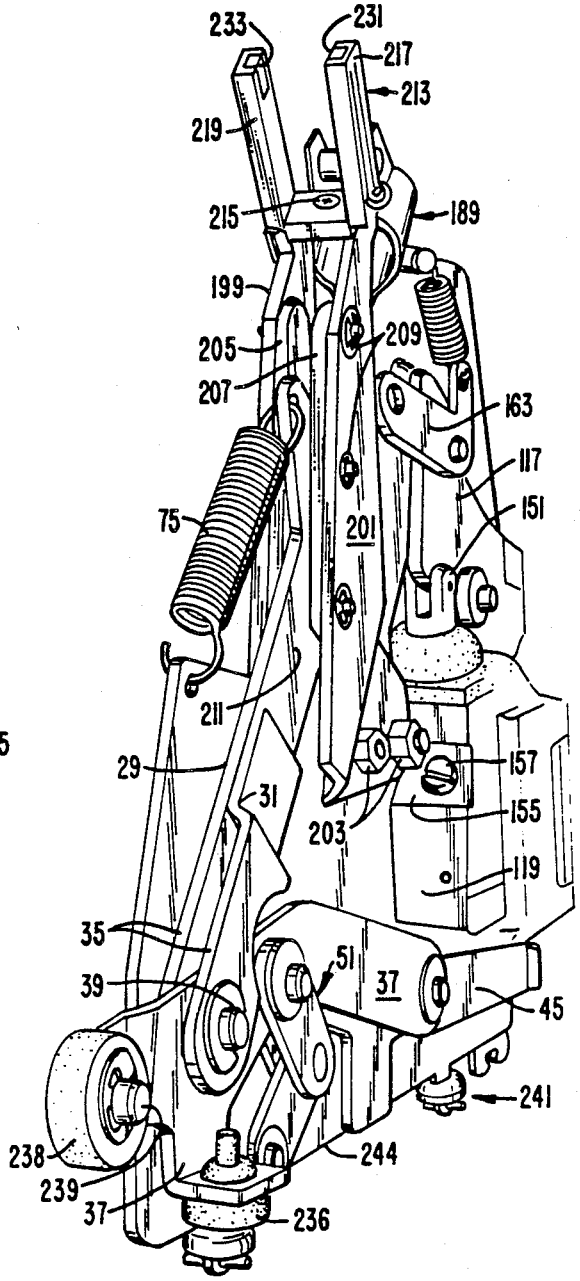
FIG. 5 is a perspective view of a rotation governing module.

As seen in FIGS. 2, 4 and 5, pawl arm 15 comprises a flat shaft 29 with a generally S-shaped bar 31 attached, e.g. welded at its lower end to form a forked base 35 which straddles guide arm 37 and is pivotally attached thereto by pin 39. Pin 39 joins forked base 35 to guide arm 37, extends through an arcuate slot 41 in base plate 27, and is fixed in place at either end by circlips 43. Guide arm 37 and first trip lever 45 are pivotally mounted on pin 47 and held in place by circlip 49. Pin 47 is fixedly mounted to base plate 27, providing a stationary pivoting point for guide arm 37 and first trip lever 45. Guide arm 37 thus pivots about pin 47 while pin 39 rides in arcuate slot 41, preventing lateral movement of guide arm 37 and forked base 35 away from base plate 27.

Figure 2A:
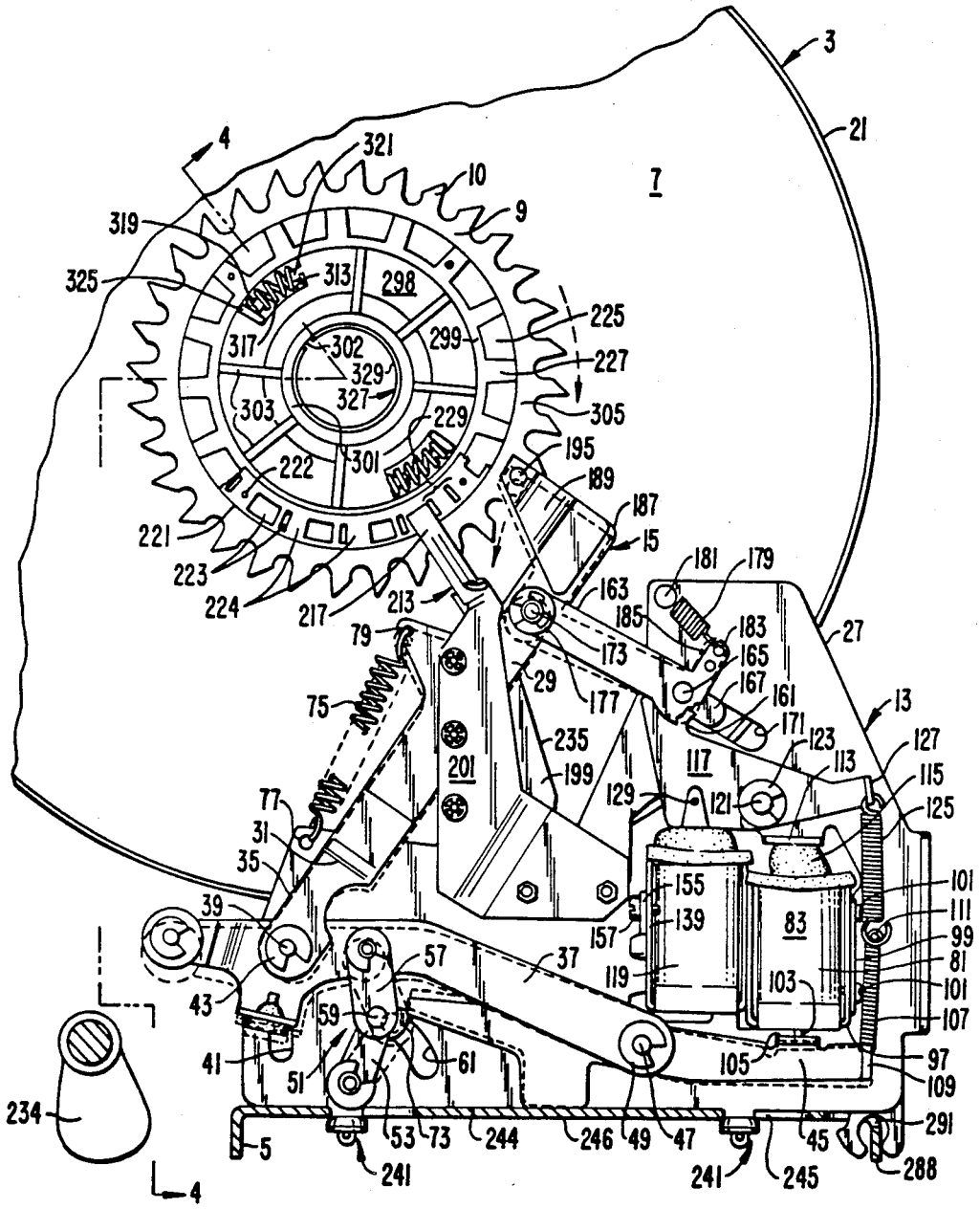
FIGS. 2A–2C are elevational views of a reel assembly and rotation governing module illustrating the three phases of module operation.
Figure 2B:
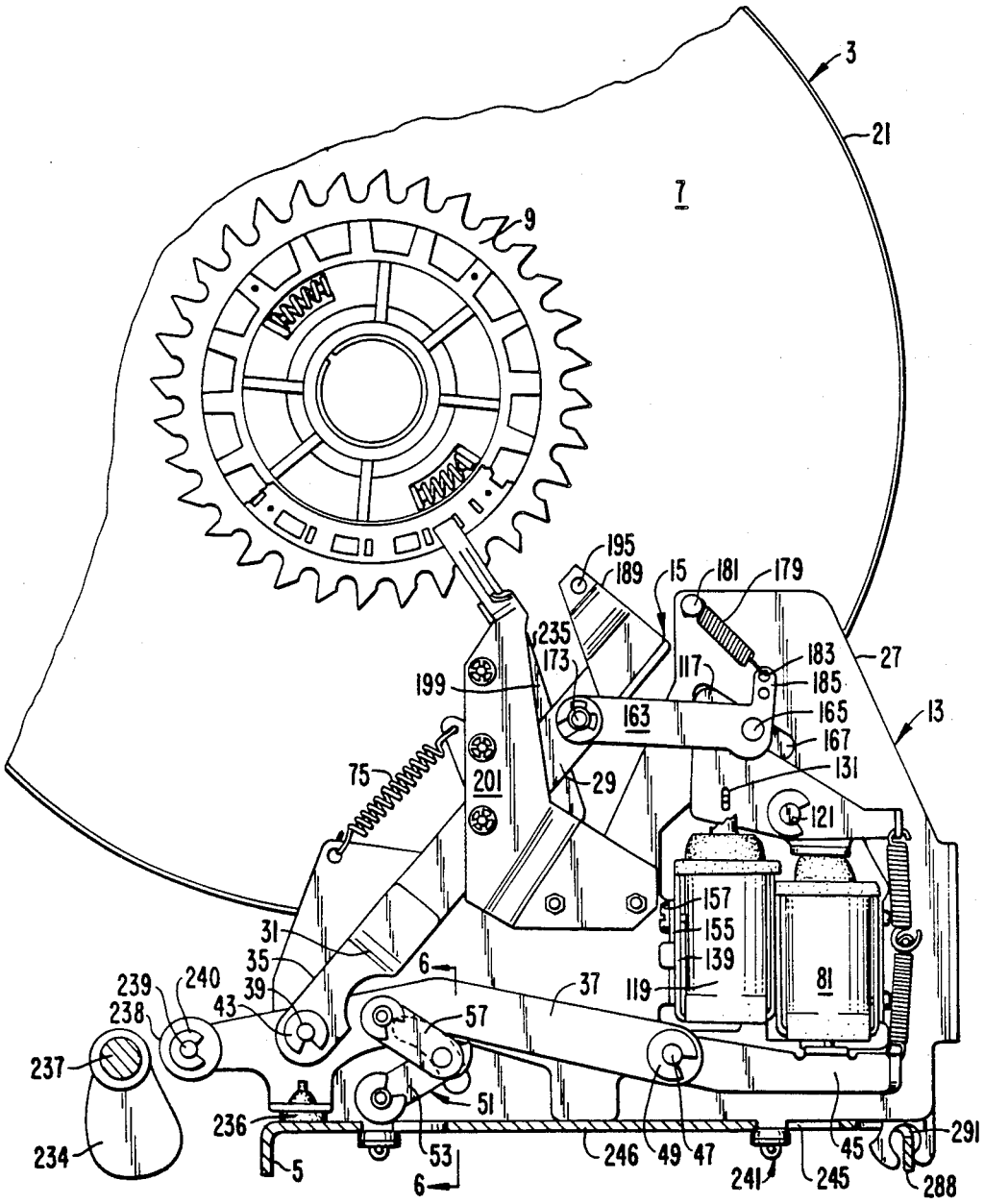
Figure 2C:
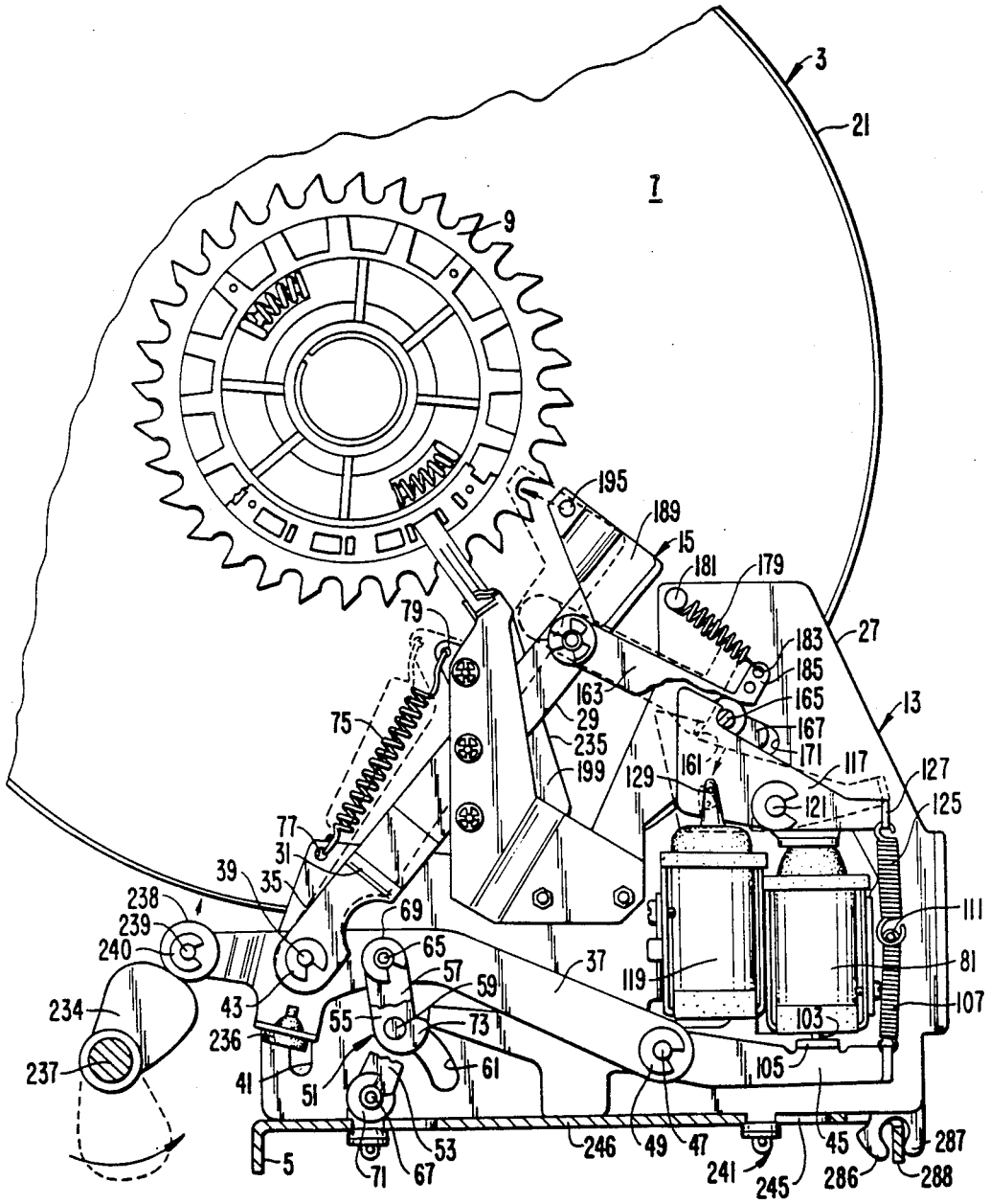
Figure 6:
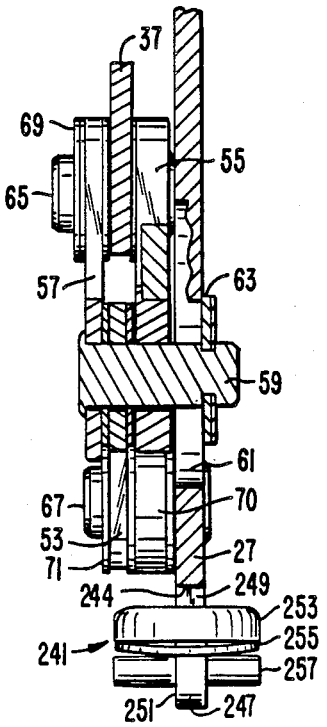
FIG. 6 is a sectional view along line 6—6 of FIG. 2B.

Toggle link 51 comprises an oval shaped lower arm 53 disposed between inner and outer upper arms 55 and 57, and pivotally connected thereto by pin 59 (see FIGS. 2C and 6). Pin 59 joins toggle link 51 and passes through arcuate slot 61 in base plate 27, and is held in place by circlip 63. Toggle link 51 is pivotally mounted at one end to guide arm 37 by pin 65 and at its other end to base plate 27 by pin 67. Pin 65 is fixed to inner arm 55 and extends through guide arm 37 and outer arm 57, which are held in place by circlip 69. Pin 67 is fixed to base plate 27 and extends through spacer 70 and lower arm 53, which is held in place by circlip 71.

As guide arm 37 pivots about pin 47, toggle link 51 pivots about pin 59, which travels along arcuate slot 61 preventing lateral movement of toggle link 51 away from base plate 27. The lower end of inner arm 55 is formed with a nose 73 which abuts first trip lever 45 when guide arm 37 is in the raised position shown in FIGS. 2A (solid lines) and 2C. Starting spring 75 extends from hole 77 in base plate 27 to hole 79 in pawl arm 15, biasing pawl arm 15 downwardly against guide arm 37. Guide arm 37 is thus locked in the position shown in FIG. 2C by the force of starting spring 75 on pawl arm 15, which urges guide arm 37 downwardly at pin 39, thus biasing the nose 73 of toggle link 51 against first trip lever 45.

Figure 7:
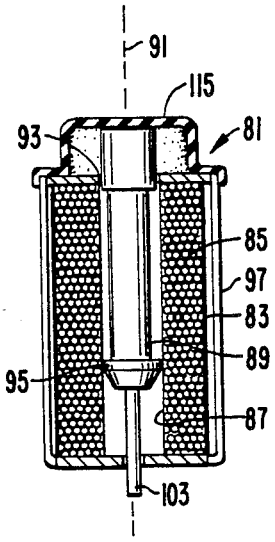
FIG. 7 is a cross-sectional view of a starting solenoid used in the rotation governing module.
Figure 3:
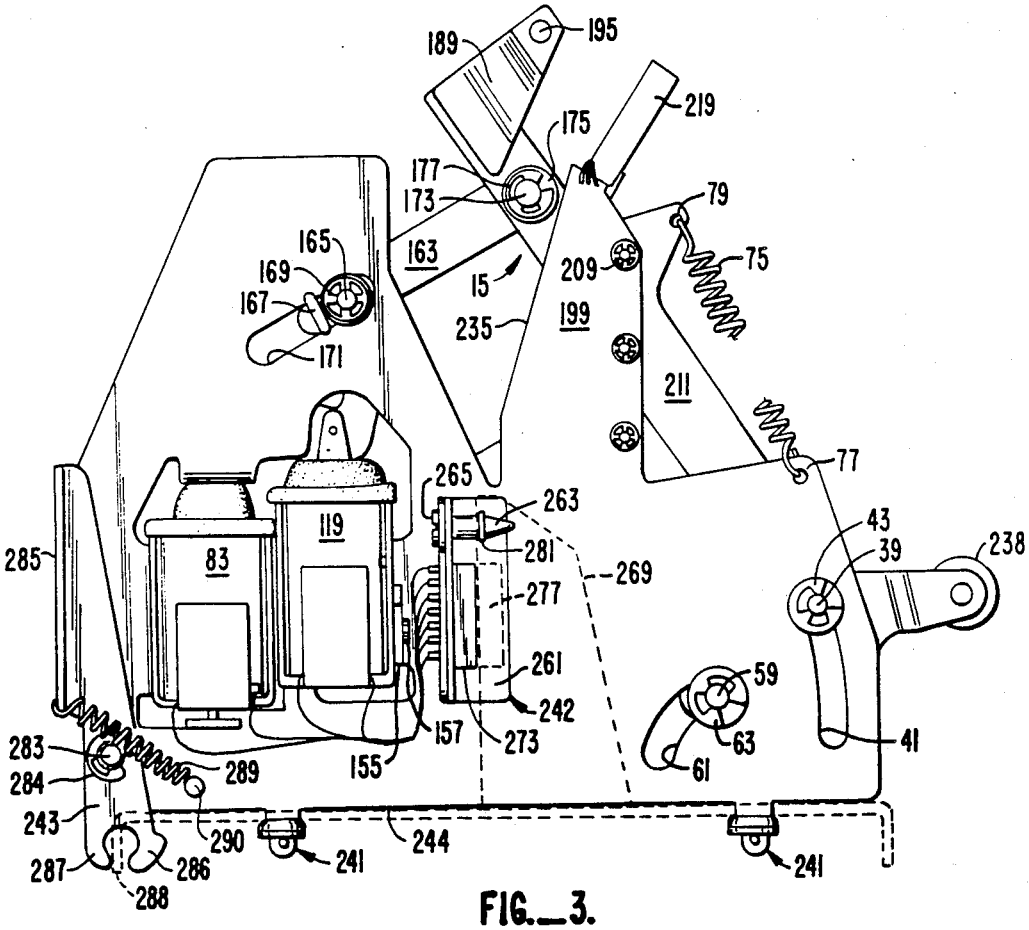
FIG. 3 is an elevational view of the back side of a rotation governing module.

First trip lever 45 may be pivoted from the set position seen in FIGS. 2A and 2C to the release position of FIG. 2B through the actuation of start solenoid 81. As seen in FIGS. 2, 3 and 7, start solenoid 81 comprises a cylindrical plastic housing 83 containing start coil 85. Housing 83 is formed with a cylindrical inner wall 87, which serves as an elongate guide surface for ferromagnetic start plunger 89. Plunger 89 is slidably disposed in housing 83 along the axis 91 of solenoid 81, and is arranged relative to coil 85 such that energization of coil 85 thrusts plunger 89 downwardly against first trip lever 45.

Plunger 89 comprises an elongate shaft having axially separated cylindrical guide regions 93 and 95 each engaging a small fraction of guide surface 87 as the plunger moves relative thereto along solenoid axis 91. The surface of plunger 89 between guide regions 93 and 95 is turned to a smaller diameter than the guide regions, and is thus spaced apart from guide surface 87 as the plunger slides along axis 91. This feature reduces surface contact between the plunger and its opposed guide surface, resulting in lower sliding friction and smoother solenoid operation than is obtained with a conventional, constant diameter shaft. It also creates a cavity for buildup of foreign residue, which would otherwise lodge between the plunger and guide surface. This is particularly important in the environment of the amusement machine discussed herein, in which the rapid starting and stopping of reels 7 creates significant residual buildup which may lodge in the solenoids, slowing down their operation and requiring frequent overhaul.

Start solenoid housing 83 is mounted in a rectangular framework 97 of ferromagnetic metal which provides a low reluctance flux path about the exterior of coil 85, resulting in a greater concentration of magnetic flux inside housing 83 and a greater pull on plunger 89. Start solenoid 81 is mounted to flange 99 of base plate 27 by screws 101, and is positioned so that pin 103 of plunger 89 rests on flange 105 of first trip lever 45. Spring 107 stretches from flange 109 of first trip lever 45 to boss 111 on base plate 27, biasing trip lever 45 is a counterclockwise direction about pin 47 and urging plunger 89 upwardly toward flange 113. A rubber dust boot 115 seals the top of solenoid 81 from falling dust and other contaminants, and reduces vibration caused by the impact of plunger 89 against flange 113 after actuation of start solenoid 81.

Second trip lever 117 controls the movement of pawl arm 15 from the cocked position illustrated in FIG. 2C to the reel set position of FIG. 2A. It is released by the actuation of stop solenoid 119, which pivots lever 117 in a counterclockwise direction about pin 121 in response to a signal from control device 16 for stopping the rotation of reel 7. This signal is timed, in conjunction with the rotational speed and position of reel 7, to stop the reel's rotation at a specific position selected by the control device.

Pin 121 is fixed to base plate 27 and extends through lever 117, which is held in place by circlip 123. Lever 117 is biased for clockwise movement about pin 121 by spring 125, which stretches from boss 111 to flange 127 of lever 117. It is connected to stop solenoid 119 by split pin 129, which extends through slot 131 (FIG. 2B) in lever 117 and permits pivotal movement of the lever about pin 121 as described below.

Figure 8:
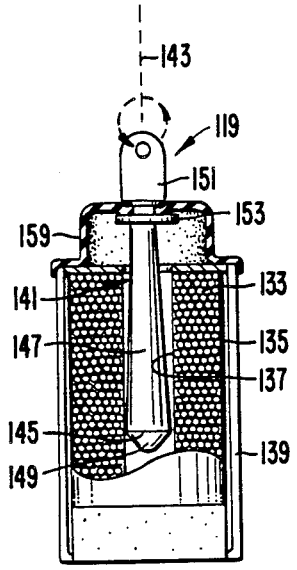
FIG. 8 is a cross-sectional view of a stop solenoid used in the rotation governing module.

As seen in FIG. 8, stop solenoid 119 comprises a housing 133, stop coil 135, cylindrical guide surface 137, and ferro-magnetic framework 139, which are similar to corresponding members 83, 85, 87 and 97 of start solenoid 81. A ferro-magnetic stop plunger 141 is slidably disposed in housing 133 along the axis 143 of solenoid 119, and is arranged relative to coil 135 such that energization of the coil thrusts plunger 141 upwardly against second trip lever 117.

Plunger 141 comprises a tapered elongate shaft having a guide region 145 at the point of greatest cross-sectional diameter, which is designed to engage a small fraction of cylindrical guide surface 137 as the plunger 141 slides along solenoid axis 143. The balance of the plunger surface within housing 133 is tapered away from guide surface 137 both above and below guide region 145, forming frusto-conical surfaces 147 and 149 on either side of the guide region. The portion of plunger 141 above frusto-conical surface 147 and outside of housing 133 comprises a yoke 151 which straddles second trip lever 117, as seen in FIG. 5, and is slidably fixed thereto by split pin 129. A collar 153 is formed between yoke 151 and frusto-conical surface 147, having a greater diameter than cylindrical guide surface 137 so as to limit the downward travel of plunger 141.

The tapered surfaces 147 and 149 of plunger 141 permit the plunger to slide axially within cylindrical guide surface 137 while simultaneously pivoting about guide region 145, thus permitting lateral movement of yoke 151 away from solenoid axis 143. This is particularly useful in the present invention, since the pivotal movement of second trip lever 117, to which yoke 151 is linked through slot 131, results in an arcuate movement of slot 131 as the lever is pivoted, with a component of motion transverse to solenoid axis 143. Accordingly, the ability of plunger 141 to pivot about guide region 145 enables it to slide axially without binding against guide surface 137 while yoke 151 follow the arcuate movement of trip lever 117. It also reduces surface contact between the plunger and its opposed guide surface, and reduces susceptibility to jamming from foreign residual build up as discussed above with respect to start solenoid 81. Furthermore, the preferred frusto-conical shape of surfaces 147 and 149 permits this pivotal movement to take place with a plunger that is relatively simple to machine and retains more metal mass inside the solenoid housing than other shapes.

Stop solenoid 119 is mounted to flanges 155 by screws 157, which are threaded into rectangular framework 139. A rubber dust boot 159 surrounds yoke 151 and covers the top of stop solenoid 119 to reduce build up of contaminants therein.

Trip lever 117 is formed with a C-shaped catch 161 (FIGS. 2A, 2C) which holds stop lever 163 in place when pawl arm 15 is in the cocked position illustrated in FIG. 2B. Stop lever 163 is L-shaped and is slidably and pivotally mounted to base plate 127 by pin 165. Pin 165 is fixed to stop lever 163, extends through plastic insert 167, and is held to base plate 27 by circlip 169. Insert 167 is shaped to slide in oval slot 171, thus permitting stop lever 163 to simultaneously slide and pivot relative to base plate 127.

Pin 173 joins stop lever 163, pawl arm 15 and guide wheel 175, and is fastened at either end by circlips 177. Stop spring 179 extends from boss 181 on base plate 27 to hole 183 at the tip of foot 185 on stop lever 163. Stop spring 179 is oriented generally perpendicular to start spring 75, so as to minimize interfering forces in the phases of operation governed by these two springs. When pawl arm 15 is in the cocked position, shown in solid lines in FIG. 2C, spring 179 biases pin 165 against C-shaped catch 161 of trip lever 117. After lever 117 is released by stop solenoid 119, spring 179 urges stop lever 163 upwardly and to the left, causing pawl arm 15 to engage sprocket 9, as shown in the dotted lines of FIG. 2C and set forth in further detail below.

Figure 9:
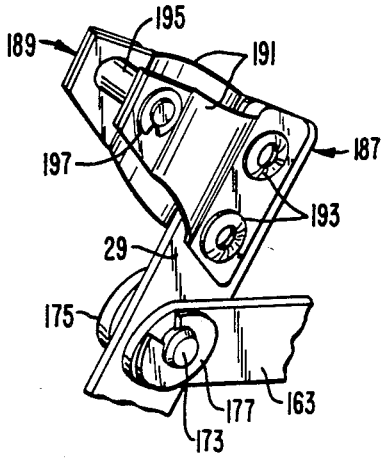
FIG. 9 is a close-up perspective view of the engaging end of the pawl arm used in the rotation governing module.

Pawl arm 15 comprises an upper portion, or engaging end 187 which is guided by the linkage system of module 13 to both spin and stop its corresponding reel assembly 3. As seen in FIGS. 4 and 9, engaging end 187 comprises a resilient bracket 189 extending toward sprocket 9 from shaft 29. Bracket 189 comprises two spring metal arms 191 fixed to shaft 29 by rivets 193. Bracket arms 191 are spaced sufficiently far apart to straddle the periphery of sprocket 9, and are respectively joined to the opposite ends of cylindrical pin 195 by circlips 197. Pin 195 is thus suspended away from shaft 29, parallel to axle 11, by resilient arms 191, which damp the high frequency shock waves arising from the radial and circumferential impact of pin 195 against sprocket 9. Arms 191 extend from shaft 29 to either side of pin 195 in a curved path, causing the bracket arms to flex outwardly upon such impact and then return to their former configuration after absorbing the initial shock. Arms 191 also flex so as to absorb the circumferential impact of tooth 10 against pin 195, to reduce high frequency shock loads caused by such impact.

As seen in FIGS. 4 and 5, the movement of pawl arm 15 is guided between upright extension 199 of base plate 27 and opposed guide plate 201 which is mounted to base plate 27 by lock nuts 203. Low friction guide pads 205 and 207 are mounted respectively to upright 199 and guide plate 201 by circlips 209, creating a pair of flat, parallel, opposed guide surfaces bordering the flat central portion 211 of pawl arm 15. Pawl arm 15 is thus free to travel within a plane of motion perpendicular to the axis of reel assembly 3, defined by the space between the surfaces of guide pads 205 and 207, while being restricted from lateral movement relative thereto.

U-shaped sensor 213, mounted on top of guide plate 201 by screw 215, is used to sense the rotational position of corresponding reel assembly 3. Sensor 213 comprises two spaced apart arms 217 and 219 which extend upwardly toward the center of sprocket 9 and straddle coding ring 221 (FIG. 2A), which engages projections 222 of sprocket 9 and rotates therewith.

Coding ring 221 is formed with a series of slots 223 for identifying the rotational position of reel assembly 3. A repetitive pattern 224 of adjacent long and short slots is positioned over all but one of the"windows" 225 in between spokes 227 of sprocket 9. A homing pattern 229, consisting of two short slots, is positioned at a single location on coding ring 221 over the remaining window 225.

As sprocket 9 rotates, a light emitting diode 231 on outer arm 217 is pulsed by control circuit 16, transmitting light toward photodiode 233 on inner arm 219. The intermittent blocking and passage of light by slots 223 of coding ring 221 transmits a digital signal to control circuit 16 via photodiode 233, which changes state each time a new slot 223 rotates into or out of alignment with sensor 213. Control device 16 may thus monitor the rotational position of sprocket 9 by counting the number of patterns 224 that have passed by sensor 213 since the passage of the last homing pattern 229.

The operation of a rotation governing module 13 and its corresponding reel assembly 3 will now be described with reference to FIGS. 2A–2C. Module 13 governs the rotational starting and stopping of reel assembly 3 by guiding pawl arm 15 through a timed, three phase movement powered by starting spring 75, cam 234, and stop spring 179. In the first of these phases, pawl arm 15 moves from the "reel set" position of FIG. 2A to the "reel spin" position of FIG. 2B, setting the reel assembly 3 in motion. In the second phase, the pawl arm moves from the "reel spin" position to the "cocked" position seen in solid lines in FIG. 2C. In the third and final phase the pawl arm moves from the "cocked" position back to the "reel set" position of FIG. 2A, to stop the reel assembly's rotation until the next round of game play.

Prior to the first phase of operation, starting spring 75 is stretched between pawl arm 15 and base plate 27, exerting a generally downward force urging the pawl arm toward pin 39 of guide arm 37. As described above, guide arm 37 is held in a "set" position (FIG. 2A, solid lines) by first trip lever 45, which butts against the nose 73 of toggle link 51 to keep the toggle link from collapsing under the pressure of starting spring 75. Stop spring 179 is in a substantially retracted position, exerting light pressure on pawl arm 15 through stop level 163 to hold pin 195 in the valley between its two adjoining teeth 10 on the periphery of sprocket 9.

To initiate a round of game play, a player inserts one or more coins in the machine 1 (according to the desired game playing format, as discussed later in the specification) and pulls starting lever 17, which sends an electrical signal to control circuit 16 to start the rotation of reel assemblies 3A to 3C. Upon receipt of this signal, control circuit 16 pulses start solenoid 81, drawing plunger 89 downwardly and pushing pin 103 against flange 105 of first trip lever 45. Trip lever 45 rotates clockwise against the force of spring 107, raising its left end out of abutment with nose 73 of toggle link 51, as seen in the dotted lines of FIG. 2A. Toggle link 51 then collapses under the pressure of starting spring 75, allowing guide arm 37 to pivot counterclockwise about fixed pin 47. This draws pawl arm 15 down and to the left, in a direction generally tangential to sprocket 9, to the position shown in dotted lines in FIG. 2A. At that point, guide wheel 175 of pawl arm 15 (FIG. 3) contacts the sloping guide surface 235 of upright extension 199 and rolls along that surface, guiding pawl arm 15 downwardly to the right under pressure of starting spring 75 until rubber bumper 236 contacts the floor of frame 5, as seen in FIG. 2B.

Thus, during the first phase of movement, pin 195 of pawl arm 15 follows a dogleg path which rapidly initiates reel rotation in a direction tangential to the sprocket and then retracts from between its adjoining teeth 10, permitting the reel assembly 3 to rotate. Teeth 10 on sprocket 9 are asymmetrically shaped so as to present a sharply sloped, substantially radially directed surface on the side of the tooth which faces the direction of rotation, and a more gradually sloped rearward facing surface which enables pin 195 to withdraw more smoothly from the rotating sprocket.

As guide wheel 175 moves down guide surface 235, stop lever 163 moves counterclockwise about both pins 173 and 165 and pushes pin 165 downwardly to the right in slot 171. As pin 165 approaches the lower end of the slot, it passes C-shaped catch 161 in second trip lever 117, enabling that trip lever to pivot clockwise about pin 121 under tension of spring 125. This places catch 161 in a position blocking the return of pin 165 to the high end of slot 171, permitting pawl arm 15 to be "cocked" during the second phase movement.

The second phase of pawl arm movement takes place immediately after the first phase, while the reel assembly is spinning, to move the pawl arm from the reel spin position of FIG. 2B to the cocked position of FIG. 2C, so that a reel stopping operation may be performed. Control circuit 16 starts the rotation of a slow, high torque motor (not shown) which rotates a shaft 237 to which cams 234A–C (corresponding to modules 13A–C) are attached, causing each cam to rotate into contact with its associated cam follower wheel 238 and lift guidearm 37 to the position shown in FIG. 3C. Cam follower wheel 238 is rotatably mounted at the end of guidearm 37 by fixed pin 239, and held in place by circlip 240. Cams 234A–C are mounted at different rotational positions on shaft 237, so that only one guide arm 37 is lifted at one time, to minimize the load on the cam driving motor.

During the second phase of pawl arm movement, as guidearm 37 is lifted to the position seen in FIG. 2C, pin 165 of stop lever 163 initially slides upwardly to the left in slot 171 until it is stopped by C-shaped catch 161 of second trip lever 117. During this initial portion of the movement, the engaging end 187 of pawl arm 15 moves upwardly to the left with guide wheel 175 contacting guide surface 235, under light pressure from partially extended starting and stop springs 75 and 179. When pin 165 is stopped by catch 161, stop lever 163 must pivot clockwise about the pin in order for cam 234 to continue lifting guide arm 37, causing the engaging end 187 of the pawl arm to move upwardly to the right, moving guide wheel 175 away from guide surface 235 and stretching both starting and stop springs 75 and 179.

As cam 234 lifts guide arm 37 to its peak, the left end of first trip lever 45 clears the nose 73 of toggle link 51 and drops down, under tension of spring 107, to the position shown in FIG. 2C. Cam 134 then continues to rotate counterclockwise, out of contact with cam follower wheel 238, leaving guide arm 37 locked in position by the downward pull of starting spring 75 on pawl arm 15 and the resulting pressure of nose 73 against first trip lever 45. Pawl arm 15 thus remains in the cocked position of FIG. 2C (solid lines), with both starting spring 75 and stop spring 179 fully extended, until the third phase movement is triggered.

As reel assembly 3 spins, its rotational position is constantly monitored by control circuit 16 through the digital pulses generated by the interaction of coding ring 221 and sensor 213. Control circuit 16 also determines the new position at which reel 7 is to be stopped, and issues an electrical pulse to stop solenoid 119 when the signal from coding disk 221 corresponds to the desired new reel position, less a lag time factor to compensate for delay due to solenoid energization and pawl arm travel.

The third phase movement of pawl arm 15 is initiated when solenoid 119 receives the stop pulse from control circuit 16. Stop plunger 141 is drawn downwardly by coil 135, causing second trip lever 117 to pivot counterclockwise about pin 121 and moving C-shaped catch 161 out of the way of pin 165 in stop lever 163. Stop spring 179 retracts, pulling pin 165 toward the upper end of slot 171 and causing pawl arm 15 to pivot counterclockwise about pin 39 in guide arm 37. Accordingly, the engaging end 187 of the pawl arm snaps from the cocked position (FIG. 2C, solid lines) to the reel set position (dotted lines) under power of stop spring 179. This movement carries pin 195 in a generally radial direction toward the axis of sprocket 9 until it engages the sprocket's periphery in the valley between two new adjoining teeth 10, to stop the sprocket's rotation and complete the third phase operation of module 13.

Figure 10:
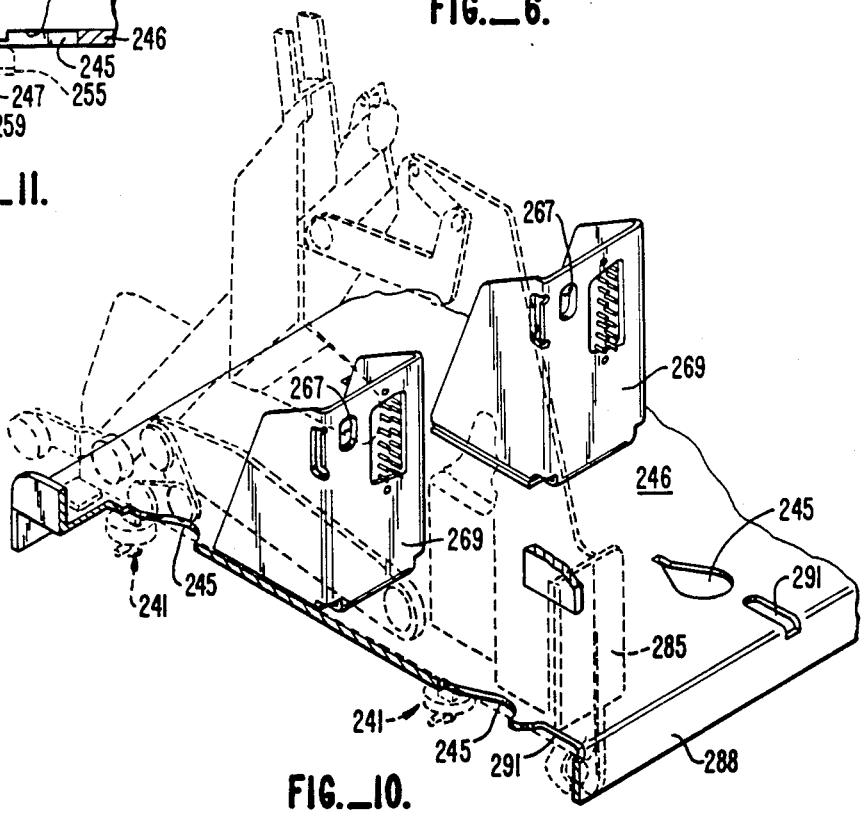
FIG. 10 is a cutaway perspective view of the floor plate of the present invention, with a rotation governing module shown in phantom view.

A particular advantage of the present invention is the ability to quickly replace any or all of modules 13 for repair or periodic maintenance. As seen in FIGS. 2, 3 and 10, module 13 is adapted for rapid insertion in frame 5 by means of guide assemblies 241, connector assembly 242 and insertion lever 243.

Figure 11:
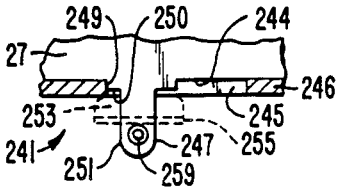
FIG. 11 is a magnified elevational view of a guide assembly used to mount a rotation governing module.

Guide assemblies 241 (FIGS. 6 and 11) extend from the lower edge 244 of base plate 27 into pear-shaped slots 245 in floor plate 246 of frame 5, providing a tight friction fit therebetween. Guide assembly 241 comprises a stepped guide post 247 integral with base plate 27. As seen in FIG. 11, guide post 247 includes an upper portion 249, which is shown seated in pear-shaped slot 245 with its lower edge 250 above the level of the bottom surface of floor plate 246. Lower portion 251 of guide post 247 extends below floor plate 246, and passes through a metal pressure disc 253 and Belleville spring washer 255 which are held in place by split pin 257 seated in hole 259. Spring washer 255 pushes pressure disc upwardly against the bottom surface of floor plate 246, creating a tight friction fit between floor plate 246 and the lower edge 244 of base plate 27.

As seen in FIGS. 3 and 4, connector assembly 242 comprises an L-shaped bracket 261 fixedly mounted on base plate 27. A tapered alignment shaft 263 is mounted to bracket 261 by screw 265, parallel to the direction of travel of module 13 during its insertion into frame 5. Shaft 263 is positioned for mating engagement with hole 267 in alignment receptacle 269, which is fixed to floor plate 246 by screws 271.

Connector half 273 is fixed to bracket 261 by screws 275, in alignment with mating connector half 277 which is loosely mounted on receptacle 269 by screws 279. This permits the mated connector to float on bracket 261, so that the principal source of contact between bracket 261 and receptacle 269 is at the interface of shaft 263 and hole 267. A rubber O-ring 281 on shaft 263 may thus be used to isolate the connector from vibration between the mated bracket and receptacle, preventing fretting of the connector pins which would otherwise require frequent maintenance due to the high vibrational environment of the invention.

Insertion lever 243 is used to facilitate the insertion and removal of modules 13 into and out of frame 5. As seen in FIG. 3, lever 243 is rotatably mounted on fixed pin 283 and held in place by circlip 284. A flange portion 285 extends away from base plate 27, providing a grasping surface for rotating the lever. The lower end of lever 243 comprises a downwardly opening fork having right and left legs 286 and 287 for straddling the front lip 288 of frame 5. A spring 289 extends between flange 285 and boss 290 on base plate 27, tensioning the lever 243 to the upright position seen in FIG. 3.

To insert a module in frame 5, lever 243 is rotated counterclockwise against boss 290, enabling guide assemblies 241 to be mated with the broad portion of pear-shaped slots 245 while right leg 286 of the lever is inserted in slot 291 at the front edge of floor plate 246 (FIG. 10). The lever is then rotated clockwise to an upright position, causing right leg 286 to push against the inside of front lip 288 and urge the module toward the rear of frame 5. As the module moves rearwardly, the upper portion 249 of each guide assembly 241 slides into the narrow portion of its corresponding pear-shaped slot 245, wedging pressure disk 253 against the bottom surface of floor plate 246 and compressing wave washer 255 to hold the base plate 27 firmly in place. During this movement, alignment shaft 263 engages hole 267 in alignment receptacle 269, guiding connector half 273 of base plate 27 into mating engagement with connector half 277 on receptacle 269 to establish electrical contact between the module and control circuit 16.

Spring 289 biases lever 243 against counterclockwise rotation, preventing the module from vibrating toward the front of frame 5. Additional security may be obtained by securing a retaining bar (not shown) across the front of the frame adjacent the tops of levers 243, after all modules have been inserted, to block counterclockwise rotation of the levers.

To remove the module from frame 5, the user simply pulls flange 285 to rotate lever 243 counterclockwise, pushing left leg 287 against the outside of front lip 288 and urging the module toward the front of the frame. This motion decouples connector halves 273 and 277 and releases the tension of guide assemblies 241, enabling the module to be lifted out of frame 5 for servicing.

Figures 12, 14:
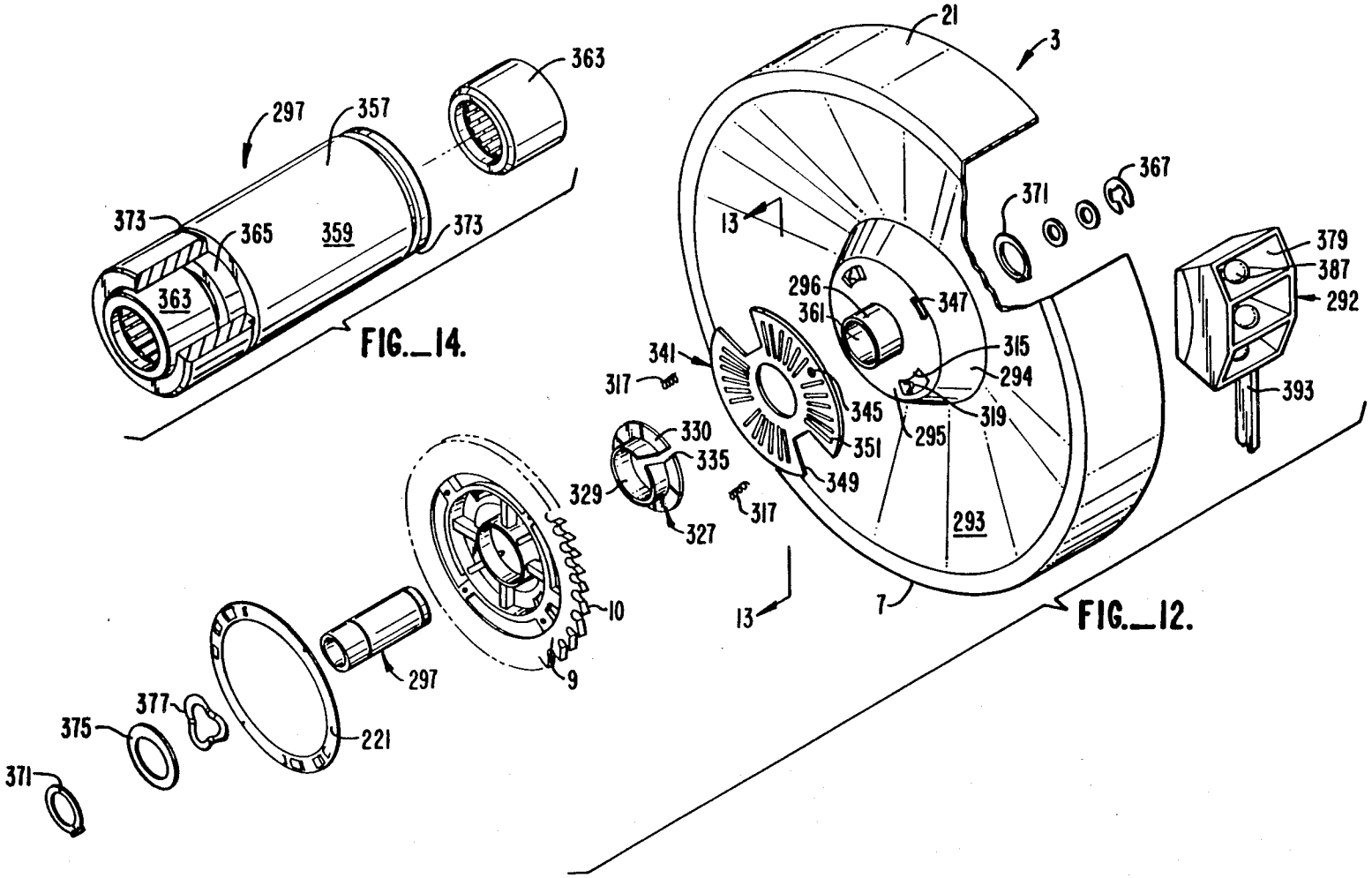
FIG. 12 is an exploded perspective view of a reel assembly and field lighting housing according to the present invention.
FIG. 14 is a magnified, partially exploded perspective view of the bearing assembly seen in FIG. 12.

FIG. 12 is an exploded view of reel assembly 3 and its associated field lighting housing 292. Reel 7 comprises a molded plastic structure of ABS plastic, such as Cycolac TM DH, having a translucent peripheral rim 21 connected by an inwardly sloping wall 293 to a frustoconical hub 294 having a flat hub face 295 disposed perpendicular to the reel axis. Reel 7 has a hollow cylindrical core 296 which extends axially on either side of hub 294 and rests on bearing assembly 297. Game playing indicia 23 are spaced about the peripheral rim 21 of reel 3 at 32 distinct locations corresponding to the thirty-two teeth 10 of sprocket 9. Thus, each time sprocket 9 is rotated from one tooth to the next, one of the game playing indicia 23 in window 25 rotates out of view and a new one moves into to the window display.

Figure 13:
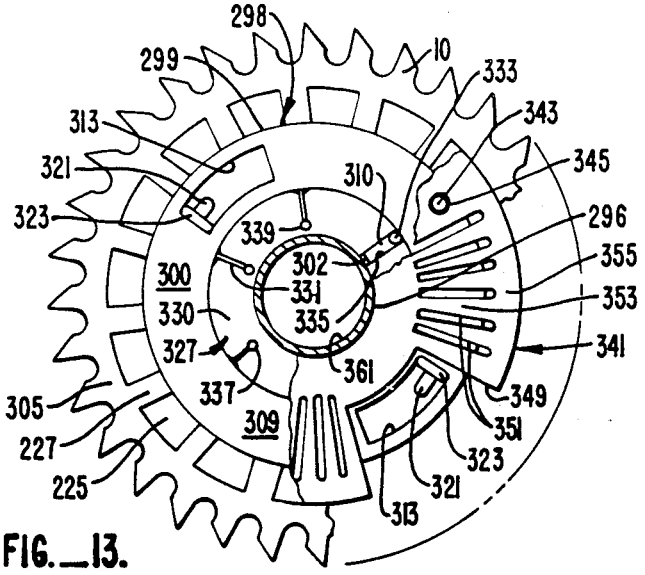
FIG. 13 is a cross-sectional view along line 13—13 of FIG. 12, showing a cutaway clutch disk and sprocket in elevation.

As seen in FIGS. 2, 12 and 13, sprocket 9 comprises a hub 298 having a cylindrical outer wall 299, a hub face 300 and a cylindrical inner core 301 having a bearing surface 302. Struts 303 extend between outer wall 299 and inner core 301 behind hub face 300, providing additional support and rigidity to the hub 298. Sixteen spokes 227 connect hub 298 to a peripheral ring 305 having thirty-two sprocket teeth 10. Spokes 227 are placed at equal arcuate intervals so as to provide sixteen equally spaced windows 225 which align with the slots 223 of coding ring 221 as discussed above. Projections 222 extend axially from four of spokes 227, for mounting coding ring 221 to sprocket 9.

Hub face 300 is formed with a stepped surface having a flat, ring-shaped outer region 309 lying in a plane perpendicular to the sprocket axis, and a concentric inner region 310 recessed from the surface of outer region 309.

Outer region 309 includes two arcuate sprocket cutouts 313 which align with two corresponding cutouts 315 in reel hub face 295, permitting a clutch spring 317 to sit in each of the spaces created in opposed hub faces 295 and 300 by a pair of aligned cutouts 313, 315 when the reel and sprocket are mounted as in FIG. 2. A bullet-shaped projection 319 extends circumferentially from one of the sides of each reel cutout 315, pointing in the direction of rotation of the reel assembly 3, and a similar bullet-shaped projection 321 extends circumferentially from one of the sides of each sprocket cutout 313, pointing in the opposite direction. Clutch spring 317 engages opposed hub faces 295 and 300 at the sides of cutouts 313 and 315, extending circumferentially between an opposing pair of reel and sprocket projections 319, 321 which are inserted into either end of the spring to hold it in place. Oval-shaped bosses 323 extend axially into reel cutouts 315 from the flat surface of outer sprocket region 309 at the sides of cutouts 313 adjacent projections 321, as seen in FIGS. 4 and 13. Corresponding bosses 325 extend axially into sprocket cutouts 313 from the flat surface of reel hub face 295 at the sides of cutouts 315 adjacent reel projections 319.

When reel assembly 3 is at rest, clutch spring 317 urges reel 7 and sprocket 9 in opposite rotational directions, pressing sprocket boss 323 against one side of reel cut out 315 and reel boss 325 against the other side of sprocket cutout 313 to hold the reel and sprocket in the angular orientation shown in FIG. 2. When sprocket 9 is spun in a clockwise direction, viewed from the sprocket side of reel assembly 3, bosses 323 and 325 interlock with cut outs 313 and 315 to prevent relative rotation of the reel and sprocket and transmit rotational force from the sprocket to the reel. When a counter-rotational or braking force is applied to sprocket 9, bosses 323 and 325 slide towards each other in each of cut outs 313 and 315, compressing clutch springs 317 which resist the clockwise inertial rotation of reel 7 relative to sprocket 9 caused by the braking force. After the inertial force of reel 7 has been absorbed by springs 317, the springs expand until the reel and sprocket return to their former angular orientation.

Sprocket 9 is a one-piece unit molded from polypenco resin, such as Nylatron GS51 TM (hereafter "Nylatron"). Polypenco TM resin is a fiberglass reinforced plastic which is especially well suited for use in the present invention because of its toughness, stiffness, and relatively light weight. It is, however, highly abrasive, and is not ordinarily used in applications where sliding contact with the material will result in rapid wear on neighboring parts. Accordingly, the reel assembly has been specially constructed to isolate sprocket 9 from frictional contact with its adjoining surfaces.

Insert 327 is removably seated in hub 298 of sprocket 9, to isolate the abrasive bearing surface 302 of sprocket core 301 from the outer surface of reel core 296, which serves as a journal for sprocket 9. Insert 327 is a molded unit formed of acetal resin, such as Delrin M-98 TM, which is strong and substantially unabrasive with respect to the ABS reel core 296.

Insert 327 comprises a cylindrical split sleeve 329, positioned between sprocket bearing surface 302 and reel core 296, and a radially outwardly extending flange 330 which fixes the axial placement of sleeve 329 and prevents insert 327 from rotating relative to the sprocket. Flange 330 is seated against the recessed inner region 310 of sprocket hub face 300 so as to lie flush with the surface of outer region 309. It is formed with five keyhole shaped notches 331 about its periphery, permitting the insert to flex so that its circumference matches that of reel core 296. Cylindrical projection 333 extends axially from a point on the outer rim of inner region 310 into the cavity formed by split 335 in flange 330. A second cylindrical projection 337 extends axially from a point on the inner rim of inner region 310 into the circular cavity 339 at the head of the keyhole notch diametrically opposite split 335. The placement of projection 333 on the outer rim of region 310 prevents the insert from properly seating unless that projection is positioned in split 335, assuring proper rotational orientation of the insert in hub 298. When sprocket 9 rotates relative to reel 7, as when braking force is applied to the sprocket, projections 333 and 337 carry insert 327 with sprocket 9 so that no abrasive movement takes place between bearing surface 302 and the insert.

Clutch plate 341 is interposed between reel and sprocket hubs 294 and 298 to isolate the abrasive surface of sprocket hub face 300 from the ABS plastic hub face 295 of reel 7. Clutch plate 341 comprises a thin disc of acetal resin, such as Delrin M-98 TM, rotatably mounted on reel core 296 between opposed hub faces 295 and 300. It is fixed for rotation with sprocket 9 by cylindrical projection 343 which extends axially from the sprocket's outer region 309 through a corresponding hole 345 in clutch plate 341 and into an arcuate slot 347 in reel hub face 295 in which the projection travels when the reel and sprocket are relatively rotated. Trapezoidal openings 349 on clutch plate 341 are provided to accommodate clutch springs 317 and reel and sprocket bosses 325 and 323, which bridge the reel and sprocket hubs 294 and 298.

To prevent the accumulation of abrasive particles and other contaminants between clutch plate 341 and opposed hub faces 295 and 300, clutch plate 341 has a series of radially directed oval slots 351 which collect the particles as the reel and sprocket rub back and forth during a braking operation and provide paths for centrifugal discharge of the residue as the reel assembly rotates. An inner portion 353 of clutch plate 341 is sandwiched between hub faces 295 and 300, while the remaining outer portion 355 extends radially outward beyond the periphery of the hub faces. Slots 351 in cutch plate 341 extend radially outwardly from the inner portion 353 to the outer portion 355, permitting residue collected in the slots to pass from the region between the opposed hub faces to the outside by the centrifugal force of the spinning reel assembly.

FIGS. 4 and 14 illustrate the bearing assembly 297 which supports reel assembly 3 for rotation about axle 11. Reel 7 is mounted on aluminum bushing 357 with a light press fit between the exterior bushing surface 359 and the interior bearing surface 361 of reel core 296. Bushing 359 is rotatably mounted to axle 11 by two roller bearings 363, pressed inside the bushing at either end and axially spaced apart with an oil bearing sintered sleeve 365, such as an Oilite bushing, disposed therebetween so as to spin freely on axle 11. The oil in sleeve 365 is slowly and continuously secreted in a very thin film to its adjoining roller bearings 363, providing long term lubrication of bearing assembly 297 while minimizing the attraction and accumulation of dust, to assure a constant spinning rate of reel 7.

The axial positioning of bearing assembly 297 is fixed by circlips 367 which clip into grooves 369 in axle 11 on either side of the bearing assembly. Reel 7 and sprocket 9 are axially positioned on bearing assembly 297 by circlips 371, which clip into grooves 373 in bushing 357. The length of sprocket core 301 is selected so that it extends just past the end of reel core 296 when sprocket 9 is journaled on the reel core as seen in FIG. 4. Flat washer 375 on bushing 357 is pressed against the end of sprocket core 301 by wave washer 377, such as a Belleville spring, which is mounted on bushing 357 between flat washer 375 and its adjacent circlip 371. Wave washer 377 thus applies a controlled force to clutch plate 341 to provide sufficient slippage between the reel and sprocket during a braking operation to dampen oscillations that would otherwise be caused by clutch spring 317, while permitting a return of the reel and sprocket to their original rotational orientation.

Figure 15:
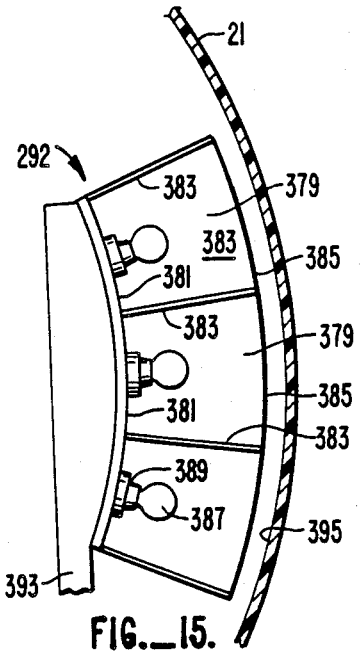
FIG. 15 is a cross-sectional view showing the relationship of a field lighting housing to its corresponding reel.
Figure 16:
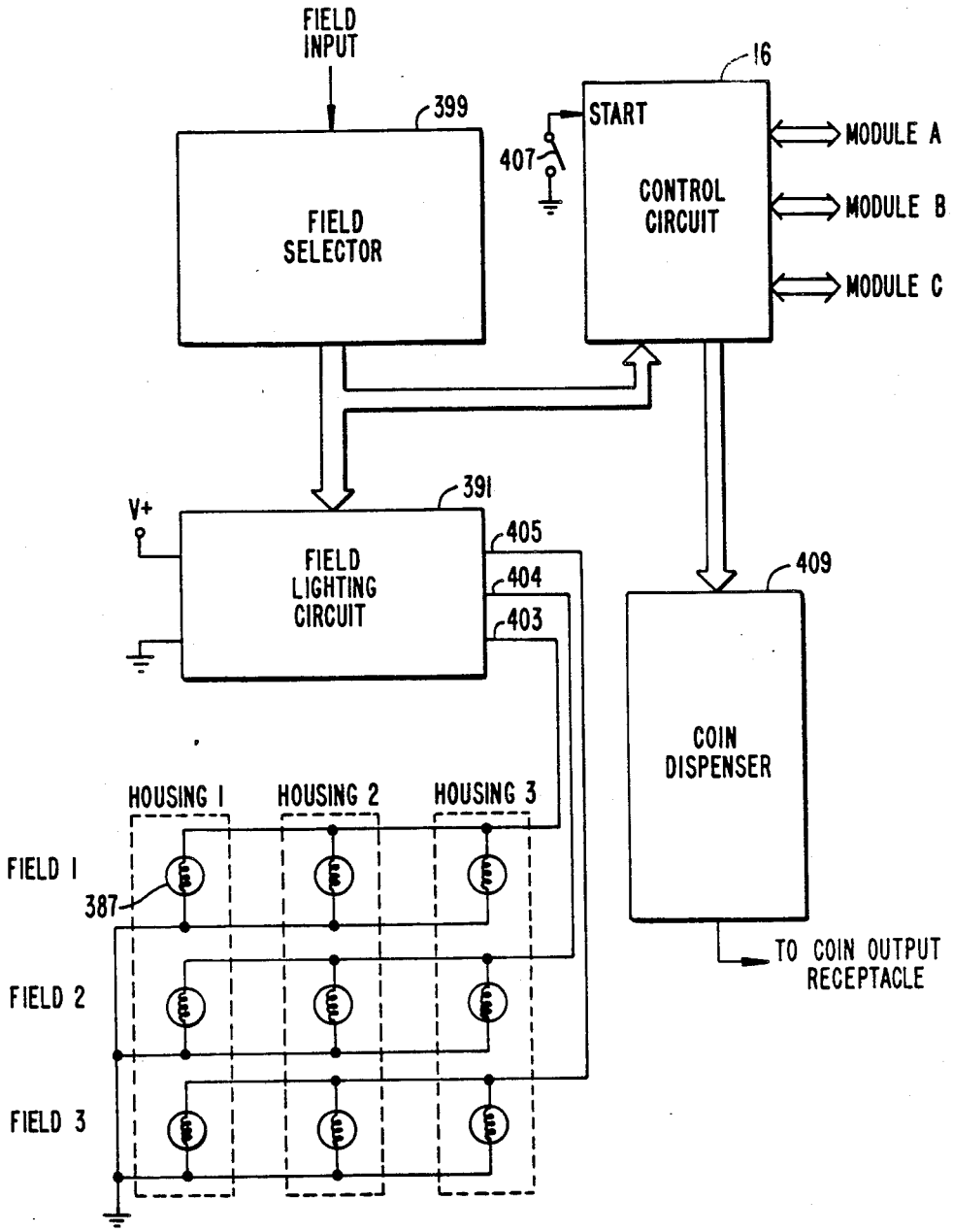
FIG. 16 is a schematic diagram of the field lighting circuitry of the present invention.

FIGS. 4, 12 and 15 illustrate the field lighting housing 292 and its placement inside the peripheral rim 21 of reel 7. Housing 292 comprises three adjacent chambers 379 each having a reflective back wall 381 and four reflective sidewalls 383 for directing light from the chamber out through a rectangular opening 385 defined by the four side walls. Lamps 387 are mounted in sockets 389 on the back wall of each chamber, and are coupled to a source of electrical power through field lighting circuit 391 as seen in the schematic view of FIG. 16.

Each reel assembly 3 is provided with a respective field lighting housing 292 mounted inside reel 7 by a supporting arm 393 which is attached to floor plate 246 and extends upwardly in the space between two adjacent reels. The openings 385 of housing 292 are positioned in close proximity to the inside surface 395 of peripheral rim 21 such that, when one of lamps 387 is lit, the reflective surfaces 383 of its respective chamber 379 will direct its light in a rectangular pattern onto a stationary arc sector through which the peripheral rim 21 rotates. The size of the arc sector is selected to correspond to the distance between indicia 23 on peripheral rim 21, which is $360° \times 1/32$, or 11.25° in the embodiment described. This light passes through the translucent rim 21 creating a rectangular frame of light on the exterior surface of the rim which may be seen through window 25.

Lamps 387 are lighted according to the number of fields which the operator selects for a given round of game play. Each field is identified by a lighted chamber 379 in each housing 292, creating a row of lighted frames arrayed in a line parallel to the reels' axis, visible through window 25. The operator may select up to three fields for a given round of game play, creating a corresponding number of illuminated rows in the window 25 of the amusement machine 1.

The operator manually selects a number of fields for the following round of game play by depositing coins or tokens of predetermined monetary or point value in coin slot 397. This action is interpreted as an input signal by field selector 399, which counts the number and/or value of coins deposited and generates a corresponding electrical signal which is transmitted to field lighting circuit 391 and control circuit 16.

Field lighting circuit 391 responds to the field number information from field selector 399 by switching electrical power to one or more of lines 403, 404 and 405 in accordance with the number of fields selected by the operator. Line 403 is connected to the sockets 389 in the top chamber of each field lighting housing 292 (field 1), line 404 is connected to the middle chamber (field 2), and line 405 to the bottom chamber (field 3). Accordingly, by depositing the appropriate number or value of coins, the operator can illuminate field 1 alone, or fields 1 and 2, or all three fields for use in the following round of game play.

After the operator has deposited the appropriate coins to select the number of fields to be played, he pulls starting lever 17, closing switch 407 to send a starting signal to control circuit 16. In response to the starting signal, control circuit 16 transmits a REEL SPIN pulse to start solenoids 81 of the three rotation governing modules 13, causing them to spin their respective reel assemblies 3A, 3B and 3C. Control circuit 16 transmits a REEL STOP pulse to each stop solenoid 119 after its respective reel has spun to a new position, and the rotational positions of the reels are identified according to the information received from sensors 213 and coding rings 221. If the sequence of indicia displayed in any of the lighted fields of window 25 matches one of a predetermined group of winning sequences, control circuit 16 determines the relative payout value of the sequence or sequences displayed, and transmits a signal to coin dispenser 409 to dispense a corresponding quantity of coins from a storage area inside the machine to a coin output receptacle 411.

From the above description it will be apparent that the subject matter of this invention is capable of taking various useful forms, and it is intended, therefore, that this disclosure be taken in an exemplary sense and the scope of protection afforded be determined by the appended claims.

What is claimed is:

1. An amusement machine comprising:

a frame;

a plurality of reels co-axially rotatably mounted in the frame;

a lever for each reel movably mounted in the frame and adapted to operatively engage the associated reel for initiating and arresting the rotation thereof;

a first spring for moving the lever in a first direction to initiate the rotation of the associated reel;

a second spring for moving the lever in a second direction to arrest the rotation of the associated reel;

activating means operatively coupled with the lever and the first and second springs for sequentially releasing the springs to move the lever in the first direction and then the second direction; and means mounted to the frame for stressing the springs prior to their release by the activating means.

2. An amusement machine according to claim 1 wherein the lever, the first and second springs and the activating means form a reel spinning and arresting module, and including means defined by the frame and the module for selectively moving each module into an operative position in the frame adjacent to the associated reel and for removing the module from its operative position in the frame, and means for releasably locking the module in its operative position to the frame.

3. An amusement machine according to claim 1, further comprising a sprocket connected with the reel for arresting its rotation, wherein the lever includes a resilient portion adapted to engage the sprocket and arranged to permit slight movement of the sprocket past its arrest position for reducing shock loads caused when the reel's rotation is arrested.

4. An amusement machine comprising:

a frame;

a plurality of reels coaxially mounted for rotation in said frame;

a corresponding plurality of discrete modules, each module releasably disposed in said frame adjacent an associated reel;

a corresponding plurality of sprocket means, coaxially mounted with said reels, each mechanically interconnecting an associated reel and module and cooperating with said associated reel for transmitting rotational force thereto;

each said module having means for engaging its associated sprocket means to start and stop the rotation of its associated reel, and means associated with each of said modules for releasably mounting its module at a designated location in said frame, including:

a slotted track disposed on one of said frame and said module;

a guide post mounted on the other of said frame and module and sized for insertion into the slot of said track; and resilient means connecting said guide post and track for tensioning said module against said frame.

5. An amusement machine as in claim 4, further comprising:

electrically powered means on each of said modules for driving its associated engaging means;

control means located exterior to said modules for providing control signals to said driving means;

said releasable mounting means including means respectively disposed on said associated module and said frame for electrically coupling said control means and said associated driving means as said module is inserted in its desired location in said frame;

said coupling means including an alignment means and connector means, said connector means comprising mating halves of an electrical connector respectively mounted on said frame and said module, and said alignment means comprises a tapered shaft and a mating receptacle mounted in opposed relation on said frame and module and situated so that, as said module is longitudinally inserted in its desired location in said frame, the tip of said shaft enters said receptacle prior to mating of said connector halves, for establishing accurate alignment thereof

6. An amusement machine as in claim 5, wherein said connector means is mounted so as to float laterally with respect to one of said frame and module when said connector halves are mated, and said tapered shaft and receptacle are mutually configured to provide a snug lateral interconnection when said module is disposed at said desired location, so as to isolate said connector means from significant lateral forces between said module and frame.

7. An amusement machine as in claim 6, further comprising a resilient member between said tapered shaft and receptacle for damping vibration between said module and frame.

8. An amusement machine as in claim 7, wherein said releasable locking means further comprises a lever pivotally mounted to one of said frame and associated module, said lever being pivotal between a locking and an unlocking position, and spring means coupled to said lever for tensioning said lever between said module and frame in said locking position when said module is disposed at said desired location.

9. An amusement machine comprising:

a frame;

a plurality of reels coaxially mounted for rotation in said frame;

a corresponding plurality of discrete modules, each module releasably disposed in said frame adjacent an associated reel;

a corresponding plurality of sprocket means, coaxially mounted with said reels, each mechanically interconnecting an associated reel and module and cooperating with said associated reel for transmitting rotational force thereto;

each said module having a base plate, pawl arm and linkage means for coupling said pawl arm to said base plate and guiding said pawl arm through a three-phase movement relative to said base plate, said three-phase movement comprising:

a first phase in which an engaging end of said pawl arm travels from a reel set position, in which said engaging end engages its corresponding sprocket means and restrains its rotation, to a reel spin position, in which said engaging end is disengaged from its corresponding sprocket means, said first phase movement following a path which causes said corresponding reel and sprocket to rotate;

a second phase in which said engaging end travels from said reel spin position to a cocked position, disengaged from its corresponding sprocket; and a third phase in which said engaging end travels from said cocked position to said reel set position, so as to restrain the rotation of its corresponding reel and sprocket, said three positions defining a plane of motion with respect to a fixed point on said engaging end;

said linkage means comprising:

spring biasing means for biasing said pawl arm toward said reel spin position when said pawl arm is in said reel set position, and for biasing said pawl arm toward said reel set position when said pawl arm is in said cocked position;

at least one trip lever means pivotally mounted to said base plate for locking said pawl arm in said cocked position after said second phase movement is completed, and in said reel set position after said third-phase movement is completed, said at least one trip lever means being pivotable to a release position for releasing said pawl arm from said cocked position and said reel set position; and cam follower means coupled to said pawl arm for moving said pawl arm from said reel spin position to said cocked position, against the resistance of said spring biasing means, when external force is applied to said cam follower means;

said module further comprising solenoid means cooperating said said trip lever means for pivoting said trip lever means to said release position upon receipt of a predetermined electrical signal, and means mounted on at least one of said frame and a respective module for releasably locking said respective module at a designated location in said frame.

10. An amusement machine as in claim 9, wherein each of said sprocket means comprises a plurality of teeth circumferentially disposed about said axis, and said engaging end includes a projection shaped to fit between adjacent teeth of said sprocket means and disposed to engage said teeth of its corresponding sprocket means when said engaging end is in said reel set position.

11. An amusement machine as in claim 10, wherein each of said projections has an initial direction of travel during its respective first phase movement substantially tangential to its corresponding sprocket means.

12. An amusement machine as in claim 11 wherein each of said projections has a direction of travel during its respective third phase movement substantially radially towards the axis of its corresponding sprocket means.

13. An amusement machine as in claim 9 wherein said solenoid means of each said module comprises independently actuatable start and stop solenoids positioned on said base plate relative to said trip lever means for releasing said pawl arm from said reel set position when a first electrical signal is received by said start solenoid, and for releasing said pawl arm from said cocked position when a second electrical signal is received by said stop solenoid.

14. An amusement machine as in claim 9, further comprising:

a cam rotatably mounted in said frame adjacent to each said module;

means for rotating each said cam during the second phase movement of its respective module; and said cam having a cam surface disposed to engage said cam follower means of its corresponding module during said second phase movement as said cam is rotated, and shaped so that the force exerted by said rotating cam on said cam follower means urges said pawl arm from said reel spin position to said cocked position.

15. An amusement machine comprising:

a frame;

a plurality of reels coaxially mounted for rotation in said frame;

each of said reels having an associated start solenoid responsive to a first predetermined electronic signal for initiating a first control movement, and a corresponding stop solenoid responsive to a second predetermined electronic signal for initiating a second control movement;

spring activated means responsive to said first control movement of each said start solenoid for initiating rotation of its corresponding reel;

spring activated means responsive to said second control movement of each said stop solenoid for stopping rotation of its corresponding reel;

manually operable input means for signalling the start of operation of said amusement machine; and means responsive to said starting signal of said input means for transmitting said first predetermined electronic signal to said plurality of start solenoids.

16. An amusement machine as in claim 15, wherein at least one of said solenoids, defined as a pivoting solenoid comprises:

a first solenoid element having an elongate guide surface;

a second solenoid element;

said first and second solenoid elements mounted to one another for relative movement generally parallel to a solenoid axis;

said second solenoid element having an elongate opposed surface facing said guide surface, said opposed surface including a guide region configured to engage a small fraction of said elongate guide surface as said first and second solenoid elements move relative to one another along the solenoid axis, while the balance of said elongate opposed surface is spaced apart from said elongate guide surface to permit relative transverse movement of said first and second solenoid elements.

17. An amusement machine as in claim 16 wherein one of said guide surface and said opposed surface comprises a cylindrical surface, and the other comprises a frusto-conical surface, said cylindrical and frusto-conical surfaces being dimensioned to permit axial mating of one surface within the other, said frusto-conical surface having minimum and maximum extremes of cross-sectional area at opposite axial ends thereof, and said guide region comprising one of said extreme regions of said frusto-conical surface.

18. An amusement machine as in claim 16 wherein at least one of said solenoids, defined as a nonpivoting solenoid, comprises:

a first solenoid element having an elongate guide surface disposed parallel to a solenoid axis;

a second solenoid element;

said first and second solenoid elements mounted to one another for relative movement parallel to said solenoid axis;

said second solenoid element having an elongate opposed surface facing said guide surface, said opposed surface including at least two axially separated guide regions, each configured to engage a small fraction of said elongate guide surface as said first and second solenoid elements move relative to one another along the solenoid axis while the balance of said elongate opposed surface is spaced apart from said elongate guide surface to reduce surface contact between said guide surface and said opposed surface while guiding said second solenoid element in an axial direction without transverse movement.

19. An amusement machine as in claim 18, wherein each of said start solenoids comprises said non-pivoting solenoid and each of said stop solenoids comprises said pivoting solenoid.

20. An amusement machine as in claim 15, wherein at least one of said solenoids, defined as a nonpivoting solenoid, comprises:

a first solenoid element having an elongate guide surface disposed parallel to a solenoid axis;

a second solenoid element;

said first and second solenoid elements mounted to one another for relative movement parallel to said solenoid axis;

said second solenoid element having an elongate opposed surface facing said guide surface, said opposed surface including at least two axially separated guide regions, each configured to engage a small fraction of said elongate guide surface as said first and second solenoid elements move relative to one another along the solenoid axis while the balance of said elongate opposed surface is spaced apart from said elongate guide surface to reduce surface contact between said guide surface and said opposed surface while guiding said second solenoid element in an axial direction without transverse movement.

21. An amusement machine comprising:

a frame;

a plurality of reels coaxially mounted for rotation in said frame;

a like plurality of sprocket means coaxially mounted with said reels, each cooperating with a corresponding one of said reels for transmitting rotational force thereto;

a like plurality of rotation governing means, each disposed adjacent a corresponding sprocket means, for starting and stopping the rotation of said corresponding sprocket means;

each rotation governing means comprising:

linkage means for coupling a pawl arm to said frame while guiding said pawl arm through a three-phase movement relative to said frame, said three-phase movement comprising:

a first phase in which an engaging end of said pawl arm travels from a reel set position to a reel spin position spaced apart from said reel set position;

a second phase in which said engaging end travels from said reel spin position to a cocked position spaced apart from said reel set and reel spin positions; and a third phase in which said engaging end travels from said cocked position to said reel set position;

said linkage means comprising:

spring biasing means for biasing said pawl arm toward said reel spin position when said pawl arm is in said reel set position, and for biasing said pawl arm toward said reel set position when said pawl arm is in said cocked position;

means for locking said pawl arm in said cocked position after said second phase movement is completed, and in said reel set position after said third-phase movement is completed, and for releasing said pawl arm from said cocked position in response to a first control signal and from said reel set position in response to a second control signal; and cam follower means coupled to said pawl arm for moving said pawl arm from said reel spin position to said cocked position, against the resistance of said spring biasing means, in response to movement of a corresponding cam engaging said cam follower means during said second phase.

22. An amusement machine as in claim 21, wherein each of said sprocket means comprises a plurality of teeth circumferentially disposed about said axis, and each said engaging end includes a projection shaped to fit between adjacent teeth of its corresponding sprocket means and disposed to engage said teeth when said engaging end is in said reel set position.

23. An amusement machine as in claim 22, wherein each of said projections has an initial direction of travel during its respective first phase movement substantially tangential to its corresponding sprocket means.

24. An amusement machine as in claim 23 wherein each of said projections has a direction of travel during its respective third phase movement substantially radially towards the axis of its corresponding sprocket means.

25. An amusement machine as in claim 21 wherein each of said rotation governing means further comprises independently actuatable start and stop solenoids positioned relative to said locking means for releasing said pawl arm from said reel set position when a first electrical signal is received by said start solenoid, and for releasing said pawl arm from said cocked position when a second electrical signal is received by said stop solenoid.

26. An amusement machine as in claim 25, wherein said spring biasing means comprises first and second springs coupled to said pawl arm and exerting substantially orthogonal forces thereon when said pawl arm is in said cocked position;

said first spring providing substantially all the force for biasing said pawl arm from said reel set position to said reel spin position, and said second spring providing substantially all the force for biasing said pawl arm from said cocked position to said reel set position.

27. An amusement machine as in claim 26, wherein said cam follower means comprises a guide arm pivotally mounted on said frame, said pawl arm being pivotally affixed to said guide arm and wherein said first spring biases said guide arm against said locking means in a fixed position when said pawl arm is in any position from said cocked to said reel set positions, whereby said pawl arm pivots about a fixed point relative to said frame under pressure from said second spring as said pawl arm moves through said third phase.

28. An amusement machine as in claim 27 wherein said locking means comprises a first lever arm mounted on said frame and pivotable between a set and release position, and wherein said first spring biases said guide arm in said fixed position against said first lever arm in said set position when said pawl arm is in any position from said cocked to said reel set position.

29. An amusement machine as in claim 28 wherein said locking means comprises a second lever arm mounted on said frame and pivotable between a set and release position, and wherein said pawl arm is biased against the set position of said second lever arm by said second spring when said pawl arm is in said cocked position, said second spring urging said pawl arm to pivot about said guide arm from said cocked position to said reel set position when said second lever arm is pivoted to its release position.

30. An amusement machine as in claim 25, further comprising:

manually operable input means for signalling the start of operation of said amusement machine; and means responsive to said starting signal of said input means for transmitting said first electrical signal to said plurality of start solenoids.

31. An amusement machine as in claim 30 wherein said start solenoid comprises a first solenoid element fixed with respect to said frame and a second solenoid element slidably disposed with respect to said first solenoid element, said second solenoid element positioned with respect to said first lever arm so as to urge said first lever arm from it set position to its release position when said start solenoid receives said first electrical signal.

32. An amusement machine as in claim 31, said stop solenoid comprising a first solenoid element fixed with respect to said frame and a second solenoid element slidably mounted relative to said first solenoid element, said second solenoid element positioned with respect to said second lever arm so as to urge said second lever arm from its set position to its release position when said stop solenoid receives said second electrical signal.

33. An amusement machine as in claim 32, wherein at least one of said start and stop solenoids, defined as a pivoting solenoid, has an elongate guide surface on its respective first solenoid element, said first and second solenoid elements being mounted to one another for relative movement generally parallel to a solenoid axis; and said second solenoid element includes an elongate opposed surface facing said guide surface, said opposed surface including a guide region configured to engage a small fraction of said elongate guide surface as said first and second solenoid elements move relative to one another along the solenoid axis, while the balance of said elongate opposed surface is spaced apart from said elongate guide surface to permit relative transverse movement of said first and second solenoid elements.

34. An amusement machine as in claim 33 wherein one of said guide surface and said opposed surface comprises a cylindrical surface, and the other comprises a frusto-conical surface, said cylindrical and frusto-conical surfaces being dimensioned to permit axial mating of one surface within the other, said frusto-conical surface having minimum and maximum extremes of cross-sectional area at opposite axial ends thereof, and said guide region comprising one of said extreme regions of said frusto-conical surface.

35. An amusement machine as in claim 33 wherein at least one of said start and stop solenoids, defined as a nonpivoting solenoid, has an elongate guide surface on its respective first solenoid element, disposed parallel to a solenoid axis, said first and second solenoid elements being mounted to one another for relative movement parallel to said solenoid axis; and said second solenoid element includes an elongate opposed surface facing said guide surface, said opposed surface including at least two axially separated guide regions, each configured to engage a small fraction of said elongate guide surface as said first and second solenoid elements move relative to one another along the solenoid axis while the balance of said elongate opposed surface is spaced apart from said elongate guide surface to reduce surface contact between said guide surface and said opposed surface while guiding said second solenoid element in an axial direction without transverse movement.

36. An amusement machine as in claim 35, wherein each of said plurality of start solenoids comprises said nonpivoting solenoid and each of said plurality of stop solenoids comprises said pivoting solenoid.

37. An amusement machine as in claim 30 wherein at least one of said start and stop solenoids, defined as a nonpivoting solenoid, has an elongate guide surface on its respective first solenoid element, disposed parallel to a solenoid axis, said first and second solenoid elements being mounted to one another for relative movement parallel to said solenoid axis; and said second solenoid element includes an elongate opposed surface facing said guide surface, said opposed surface including at least two axially separated guide regions, each configured to engage a small fraction of said elongate guide surface as said first and second solenoid elements move relative to one another along the solenoid axis while the balance of said elongate opposed surface is spaced apart from said elongate guide surface to reduce surface contact between said guide surface and said opposed surface while guiding said second solenoid element in an axial direction without transverse movement.

38. An amusement machine as in claim 25, further comprising:

a cam rotatably mounted in said frame adjacent to each said rotation governing means;

means for rotating each said cam during the second phase movement of its respective rotation governing means; and said cam having a cam surface disposed to engage said cam follower means of its corresponding rotation governing means during said second phase movement as said cam is rotated, and shaped so that the force exerted by said rotating cam on said cam follower means urges said pawl arm from said reel spin position to said cocked position.

39. An amusement machine as in claim 21, wherein each of said rotation governing means further comprises means responsive to rotation of said corresponding reel for sensing the rotational position of said reel.

40. An amusement machine as in claim 39 wherein said sensing means comprises signal transmitting means mounted apart from and in opposed relation to receiving means for sensing the presence of a signal from said transmitting means.

41. An amusement machine as in claim 21, further comprising:

means bridging each said corresponding reel and sprocket for preventing relative rotation in a predetermined rotational direction when said reel and sprocket are in a predetermined angular orientation, and for permitting relative rotation from said predetermined angular orientation in the opposite rotational direction; and resilient means engaging each said corresponding reel and sprocket for resisting relative rotation opposite to said predetermined direction when a force in that direction is applied and returning said reel and sprocket to said predetermined angular orientation when the force subsides.

42. An amusement machine as in claim 41 further comprising a clutch disc mounted coaxially with and interposed between opposing hub faces of each said corresponding reel and sprocket; and means for urging said corresponding opposed hub faces axially towards each other against said interposed clutch disc.

43. An amusement machine as in claim 42, wherein each said clutch disc comprises an inner and outer portion, said inner portion contacting said opposed hub faces on both sides of said disc and said outer portion extending radially outward beyond at least one of said hub faces, said clutch disc further comprising a plurality of slots extending radially outwardly from said inner to said outer portion for discharging accumulated residue from said inner portion.

44. An amusement machine as in claim 43 wherein each said sprocket is mounted on a corresponding journal, said sprocket having a bearing surface opposing and rotatable relative to said journal, and further comprising a replaceable split sleeve inserted in said sprocket between said bearing surface and journal and fixed for rotation therewith, said bearing surface being composed of abrasive material relative to said sleeve and journal, whereby said sleeve buffers said journal from abrasive rotational contact with said bearing surface.

45. An amusement machine as in claim 44 wherein each said sleeve includes a radially outwardly extending flange for fixing the axial placement of said sleeve relative to its corresponding sprocket, at least one of said corresponding sprocket and flange having projections extending axially into cooperative cavities in the other for preventing relative rotation of said corresponding sprocket and sleeve.

46. An amusement machine as in claim 43 wherein each said sprocket hub face is composed of abrasive material relative to its corresponding clutch disc, and at least one of said corresponding sprocket and clutch disc includes projections extending axially into cooperative cavities in the other for preventing relative rotation thereof.

47. An amusement machine as in claim 42, wherein each said reel comprises a hollow cylindrical core, and further comprising a bushing supporting each said reel and sprocket, each said cylindrical core having an interior bearing surface engaging said bushing with a light press fit, and an exterior surface comprising said journal for said corresponding sprocket.

48. An amusement machine as in claim 47 wherein said urging means comprises:

means mounted to said bushing on either side of each said cylindrical core for fixing the axial position of said corresponding reel, and spring washer means mounted on said bushing between each said sprocket and its adjacent axial fixing means, for axially compressing said corresponding reel and sprocket between two axial fixing means.

49. An amusement machine as in claim 47 further comprising two axially spaced roller bearings mounted inside said bushing with an oiled sintered sleeve disposed therebetween.

50. An amusement machine as in claim 41 wherein each said bridging means comprises a boss fixed to and extending axially from one of its corresponding reel and sprocket into a corresponding slot in the other of said reel and sprocket, said slot having a greater arcuate extent than said boss such that said boss moves freely therein over the arcuate span of said slot when said reel and said sprocket are relatively rotated.

51. An amusement machine as in claim 50 wherein each said resilient means comprises at least one coil spring disposed in a hub slot on at least of one of its corresponding hub faces and extending in a generally circumferential direction between opposed reel and sprocket projections within said hub slot.

52. An amusement machine as in claim 41 further comprising ring shaped coding means coaxially mounted for rotation with each said sprocket, comprising an electronically readable pattern at each tooth of said sprocket, at least one of said electronically readable patterns comprising a uniquely identifiable tracking pattern, for permitting electronic monitoring of the rotational position of each said corresponding reel and sprocket.

53. An amusement machine as in claim 21 wherein said engaging end of said pawl arm includes a resilient bracket with a pin fixed thereto and disposed substantially perpendicular to said plane of motion.

54. A module as in claim 53 wherein said pawl arm comprises a rigid shaft with said resilient bracket fixed thereto, said bracket comprising at least two spring metal arms extending from said shaft in a nonlinear path to either side of said pin.

* * * * *